US012497726B2

(12) United States Patent
Kim et al.

(10) Patent No.: US 12,497,726 B2
(45) Date of Patent: Dec. 16, 2025

(54) LAUNDRY TREATING APPARATUS

(71) Applicant: LG ELECTRONICS INC., Seoul (KR)

(72) Inventors: Younghun Kim, Seoul (KR); Sungwoon Jung, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 102 days.

(21) Appl. No.: 18/708,145

(22) PCT Filed: Dec. 13, 2022

(86) PCT No.: PCT/KR2022/020177
§ 371 (c)(1),
(2) Date: May 7, 2024

(87) PCT Pub. No.: WO2024/101523
PCT Pub. Date: May 16, 2024

(65) Prior Publication Data

US 2025/0257515 A1 Aug. 14, 2025

(30) Foreign Application Priority Data

Nov. 11, 2022 (KR) ..... 10-2022-0150882

(51) Int. Cl.
*D06F 39/02* (2006.01)
*D06F 37/12* (2006.01)
*D06F 39/08* (2006.01)

(52) U.S. Cl.
CPC ..... *D06F 39/022* (2013.01); *D06F 37/12* (2013.01); *D06F 39/088* (2013.01)

(58) Field of Classification Search
CPC ..... D06F 39/022
See application file for complete search history.

(56) References Cited

FOREIGN PATENT DOCUMENTS

| | | | |
|---|---|---|---|
| CN | 114108261 | A | 3/2022 |
| JP | 2021-90800 | A | 6/2021 |
| JP | 2022-522691 | A | 4/2022 |
| JP | 2022-127188 | A | 8/2022 |
| KR | 10-2006-0008399 | A | 1/2006 |
| KR | 10-2016-0049366 | A | 5/2016 |

*Primary Examiner* — Jason Y Ko
(74) *Attorney, Agent, or Firm* — Birch, Stewart, Kolasch & Birch, LLP

(57) ABSTRACT

A laundry treating apparatus includes a mounting part provided on the top cover to deliver a laundry agent to the tub and a first storage part detachably disposed in the mounting part to store the laundry agent. The mounting part may include a mounting groove allowing the first storage part to be seated therein, a communication passage provided in the mounting groove to communicate with the first storage part, and a drain hole provided in the mounting groove to communicate with the tub. The laundry agent stored in the first storage part may be delivered to the tub through the mounting part. A fluid present in the mounting groove may be discharged to the tub through the drain hole.

20 Claims, 15 Drawing Sheets

【Figure 5】
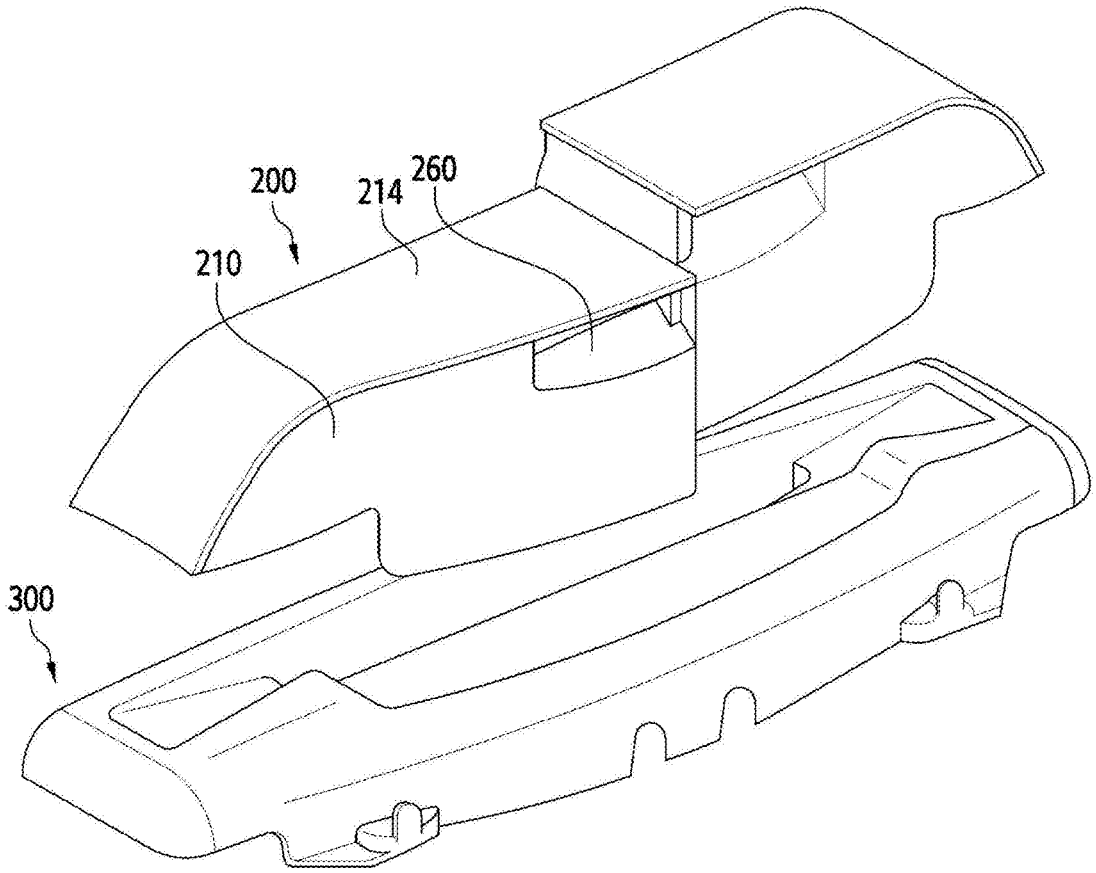
【Figure 6】
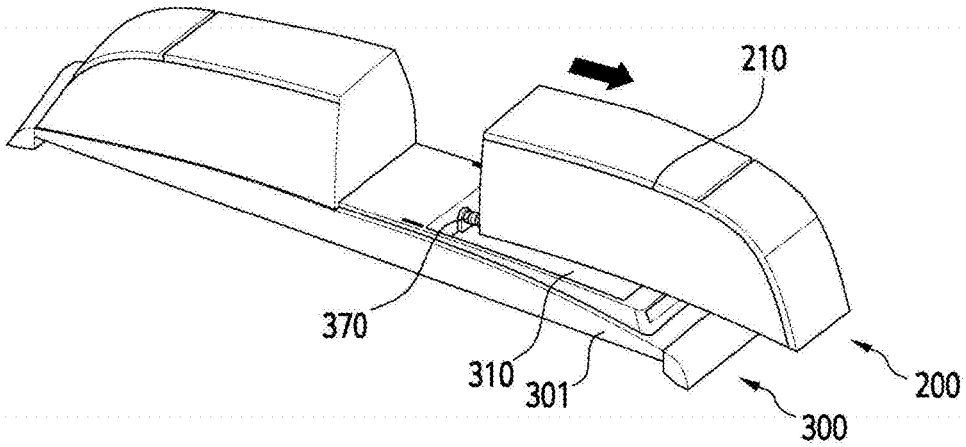

【Figure 7】
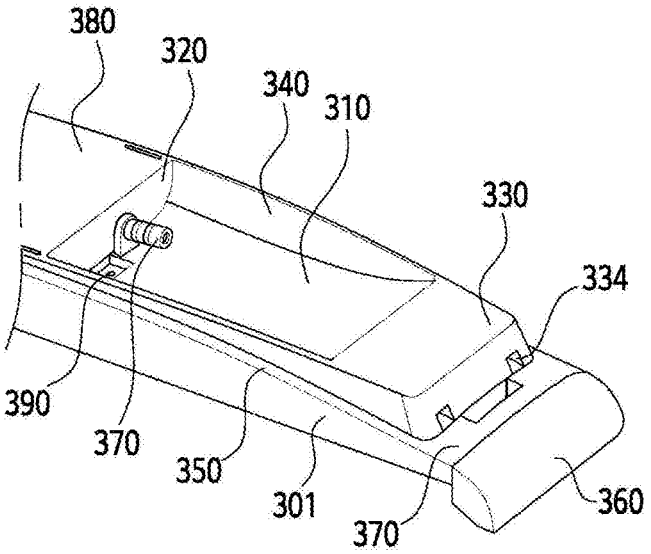
【Figure 8】
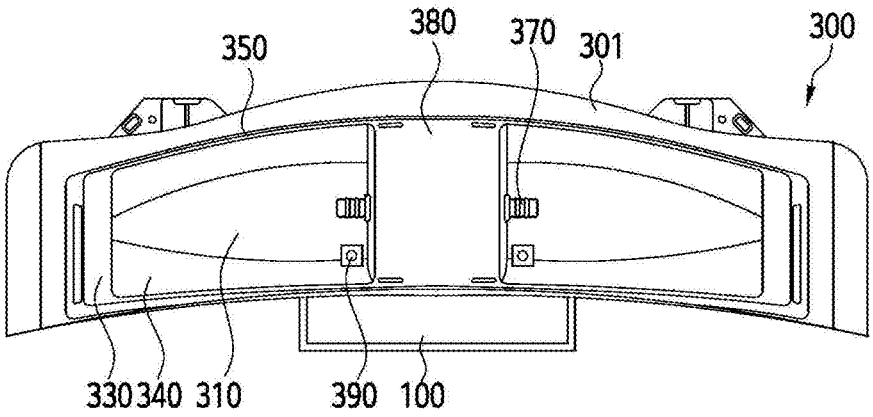

【Figure 11】
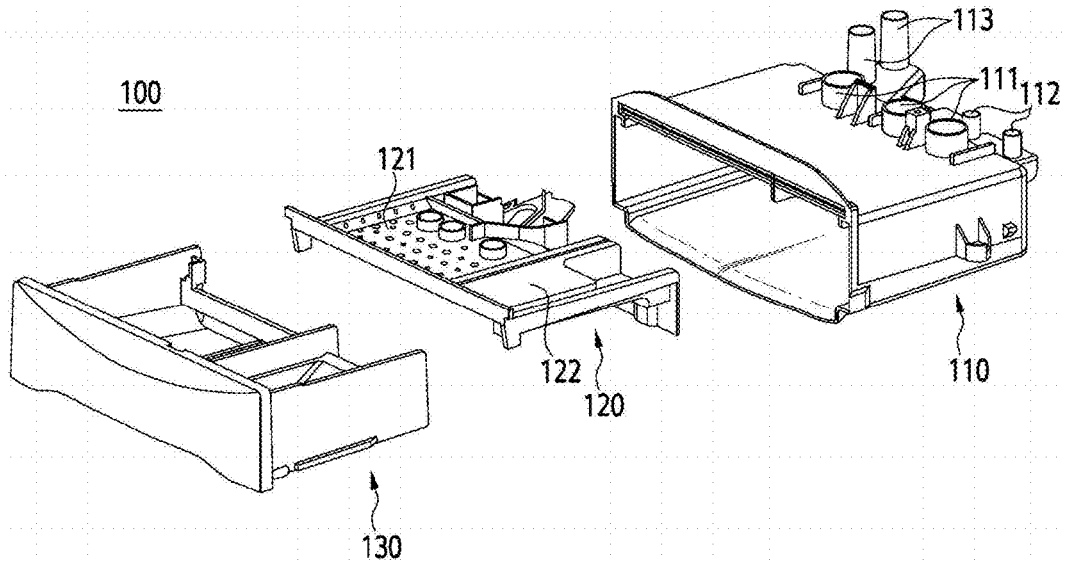
【Figure 12】
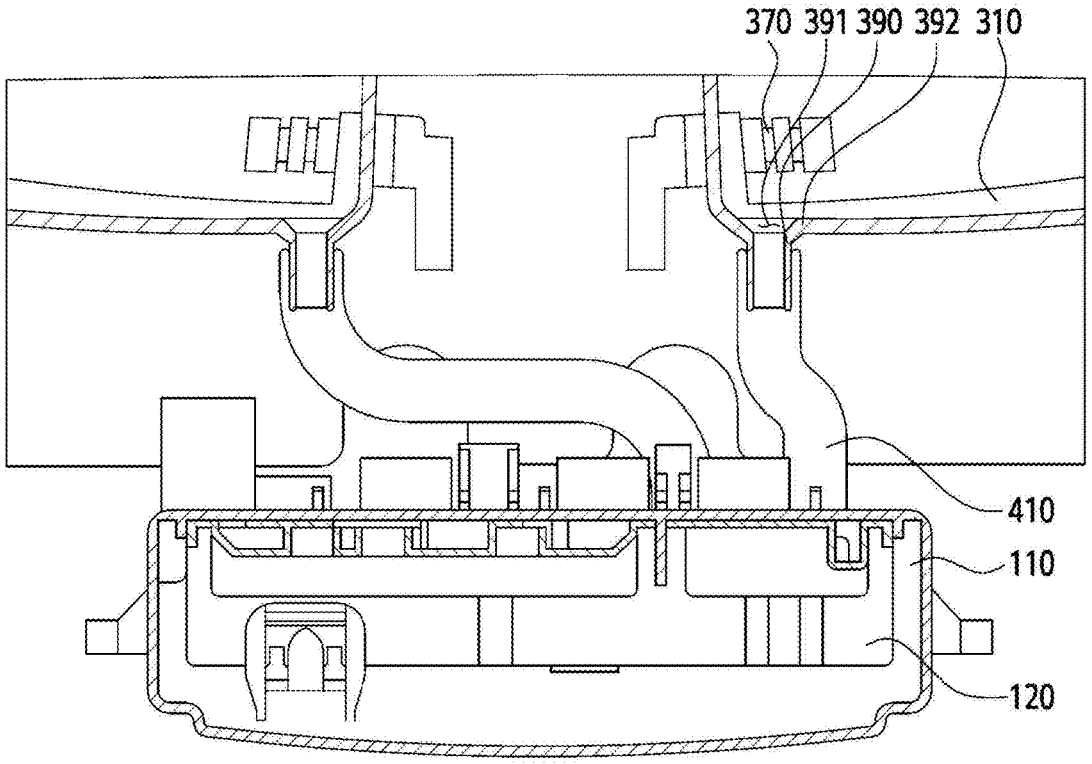

【Figure 13】
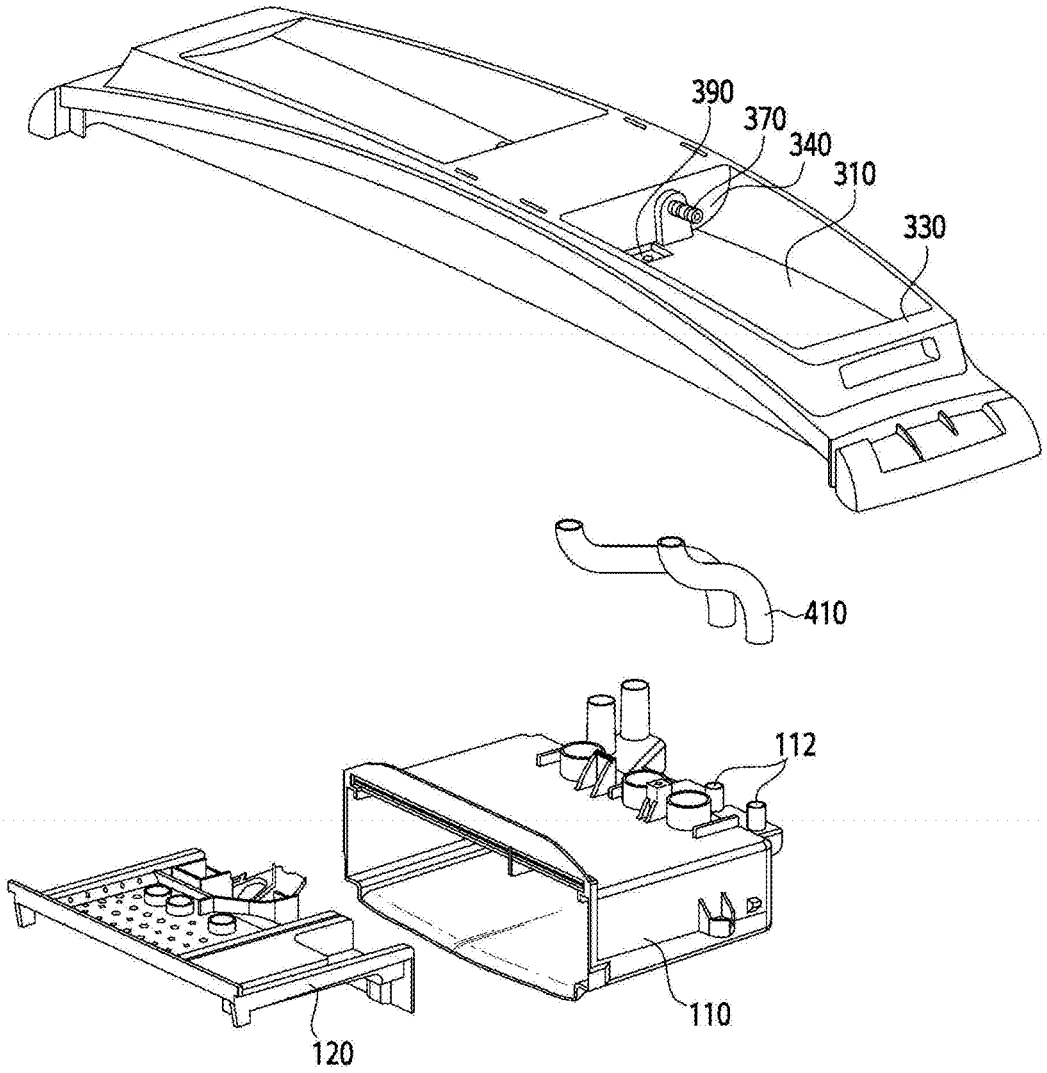

【Figure 20】
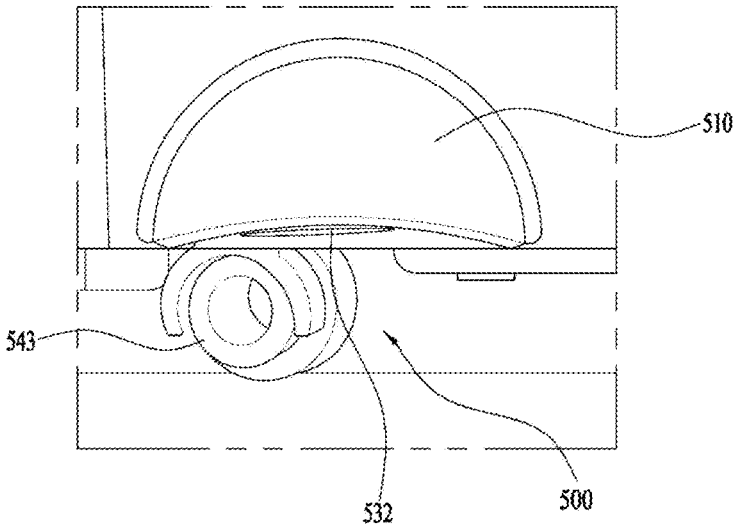
【Figure 21】
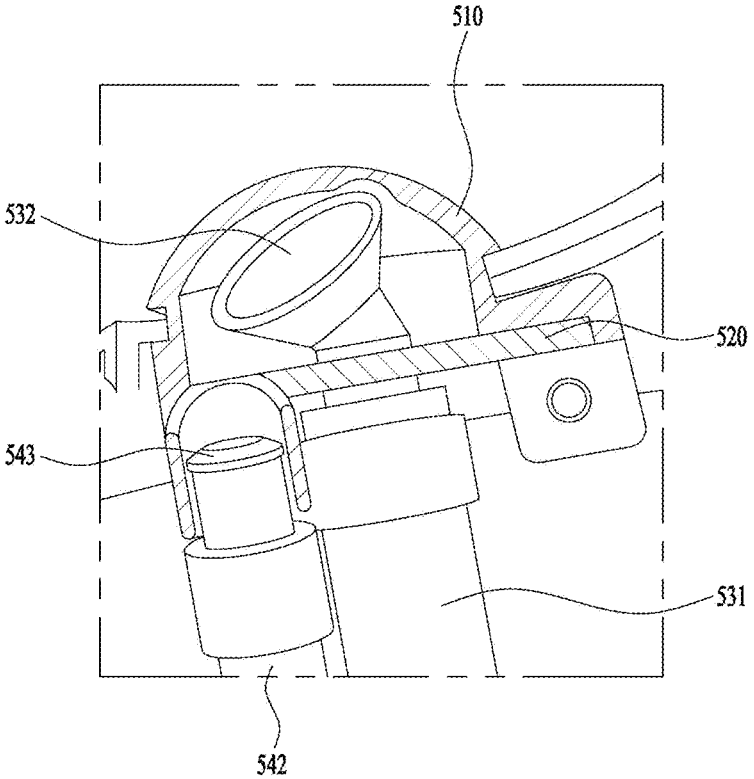

LAUNDRY TREATING APPARATUS

CROSS REFERENCE TO RELATED APPLICATIONS

This application is the National Phase of PCT International Application No. PCT/KR2022/020177, filed on Dec. 13, 2022, which claims priority under 35 U.S.C. 119 (a) to Patent Application No. 10-2022-0150882, filed in the Republic of Korea on Nov. 11, 2022, all of which are hereby expressly incorporated by reference into the present application.

TECHNICAL FIELD

The present disclosure relates to a laundry treating apparatus.

BACKGROUND ART

Generally, a laundry treating apparatus (clothing processing apparatus) is a household appliance for removing dirt from clothing by using water and detergent, and includes a tub arranged to store water, a water supply configured to supply water to the tub, and a detergent supply disposed in a flow path connecting the water supply and the tub to supply detergent to the tub together with the water. When the drum is rotated by the motor with wash water supplied to the laundry that is accommodated in the drum, dirt can be removed from the laundry by friction between the laundry and the drum and wash water.

The laundry treating apparatus is capable of performing operations such as washing, rinsing, dehydrating, and drying. Laundry treating apparatuses may be divided into a top-loading type and a front-loading type based on the method of loading the laundry into the drum.

The detergent supply device is provided with a laundry agent supply function for supplying a detergent or laundry agent (hereinafter referred to as "laundry agent") to enhance the washing effect.

Here, the laundry agent refers to a substance that enhances a washing effect, such as a fabric detergent, a fabric softener, and a fabric bleach. The laundry agent may include a powdered laundry agent or a liquid laundry agent.

Korean Patent No. 10-2205280 B1 discloses a top-loading type laundry treating apparatus including a detergent supply device.

The laundry treating apparatus applies a drawer-type automatic detergent supply device to a top-loading type washing machine having an opening at the top of a cabinet through which clothing is loaded, and a door for opening and closing the opening.

The cartridge of the automatic detergent supply device is of the drawer type, which is slidably inserted and withdrawably mounted in a dispenser housing including a water supply passage in communication with the tub.

The laundry detergent, by its very nature, deposits and solidifies over time, requiring cleaning in and around the cartridge. In addition, when inserting and withdrawing the cartridge, leaked laundry detergent or residual water from the connection port connected to the dispenser housing may remain in the cartridge.

However, when the cartridge is embedded in the laundry treating apparatus as a drawer type, as in the prior art, there is no need to remove residual water or residual detergent because the area where the connection port is positioned is not exposed to the outside of the washing machine.

However, in the case of an externally exposed type cartridge that is exposed to the outside of the laundry treating apparatus, the detergent or residual water remaining in the cartridge may be seen to the user, which may cause aesthetic degradation or hygiene issues.

Therefore, there is a need to minimize the residual detergent leaking from the connection port when the cartridge is removed.

DISCLOSURE

Technical Problem

An object of the present disclosure devised to solve the above-described problems is to provide a laundry treating apparatus capable of removing residual detergent from a seating part where a cartridge or a storage part storing detergent is seated in an automatic detergent supply device of a top-loading type washing machine.

Another object of the present disclosure is to provide a laundry treating apparatus capable of removing residual water present in the seating part in an automatic detergent supply device of a top-loading type washing machine.

Another object of the present disclosure is to provide a laundry treating apparatus capable of discharging detergent or residual water remaining in the seating part in an automatic detergent supply device of a top-loading type washing machine to a tub.

Another object of the present disclosure is to provide a laundry treating apparatus capable of minimizing the amount of detergent or residual water that remains in the seating part of an automatic detergent supply device of a top-loading type washing machine to improve the hygiene of the seating part.

Technical Solution

The object of the present disclosure can be achieved by providing a laundry treating apparatus (clothing processing apparatus) including a cabinet including a top cover provided with an inlet, a tub disposed inside the cabinet to store water, a drum rotatably disposed in the tub to accommodate laundry (clothing), a mounting part provided on the top cover to deliver a laundry agent to the tub, a first cartridge (or a first storage part) detachably disposed in the mounting part to store the laundry agent, wherein the mounting part may include a mounting groove allowing the first cartridge to be seated therein, a communication passage provided in the mounting groove to communicate with the first cartridge, and a drain hole provided in the mounting groove to communicate with the tub, wherein the laundry agent stored in the first cartridge may be delivered to the tub through the mounting part, wherein a fluid present in the mounting groove may be discharged to the tub through the drain hole.

In one embodiment, the mounting groove may be inclined downwardly towards the drain hole.

In one embodiment, the mounting part may further include a drain groove formed by recessing a portion of the mounting groove, wherein the drain hole may be formed in the drain groove.

In one embodiment, the first cartridge may be detachably arranged in the mounting part in a width direction of the cabinet.

In one embodiment, the mounting groove may include a restriction surface provided on an inner side or one end of the mounting groove to support the first cartridge, wherein the communication passage may be provided on the restriction surface, wherein the drain hole may be provided in a bottom surface of the mounting groove.

In one embodiment, the first cartridge may include a connector extending from the drain hole to allow the fluid to flow therethrough.

In one embodiment, the laundry treating apparatus may further include a second cartridge (or a second storage part) provided in the top cover to store the laundry agent in communication with the tub, wherein one end of the connector may be connected to the drain hole, and an opposite end of the connector may be connected to the second cartridge to discharge the fluid into the tub.

In one embodiment, the connector may be provided with a hose to allow the fluid to flow into the tub.

In one embodiment, the second cartridge may include a wash hole provided at a position corresponding to the drain hole, wherein the opposite end of the connector may be connected to the wash hole.

In one embodiment, the laundry treating apparatus may further include a gasket arranged at the opposite end of the connector along an outer circumferential surface of the connector.

In one embodiment, one end of the connector may be connected to the drain hole, and an opposite end of the connector may be provided in an open top of the tub.

In one embodiment, the laundry treating apparatus may further include a nozzle part disposed facing the tub, wherein an opposite end of the connector may be connected to the nozzle part.

In one embodiment, the laundry treating apparatus may further include a water supply provided in the cabinet to supply water to the tub, wherein the nozzle part may include a spray nozzle connected to the water supply and disposed facing the tub.

In one embodiment, the nozzle part may include a drainage nozzle connected to the opposite end of the connector and disposed facing the tub, wherein the spray nozzle and the drainage nozzle may be spaced apart from each other.

In one embodiment, the first cartridge may be detachably mounted on the mounting part in a height direction of the cabinet, wherein a bottom surface of the mounting groove may be provided with the communication passage and the drain hole.

Advantageous Effects

According to embodiments of the present disclosure, residual detergent may be removed from a seating part where a cartridge or a storage part storing detergent is seated in an automatic detergent supply device of a top-loading type washing machine.

According to embodiments of the present disclosure, residual water present in the seating part in an automatic detergent supply device of a top-loading type washing machine may be removed.

According to embodiments of the present disclosure, detergent or residual water remaining in the seating part in an automatic detergent supply device of a top-loading type washing machine may be discharged to a tub.

According to embodiments of the present disclosure, the amount of detergent or residual water that remains in the seating part of an automatic detergent supply device of a top-loading type washing machine may be minimized, thereby improving the hygiene of the seating part.

DESCRIPTION OF DRAWINGS

FIG. 5 illustrates an embodiment of attachment and detachment of a storage part to and from a mounting part according to the present disclosure.

FIG. 6 illustrates another embodiment of attachment and detachment of the storage part to and from the mounting part according to the present disclosure.

FIG. 7 is a perspective view showing the mounting part.

FIG. 8 is a top view showing the mounting part.

FIG. 11 shows the structure of a manual detergent supply device of the laundry treating apparatus according to the present disclosure.

FIG. 12 shows a connector according to an embodiment of the present disclosure.

FIG. 13 shows a detailed structure of the connector according to the embodiment of the present disclosure.

FIG. 20 is an enlarged view showing the sprayer.

FIG. 21 is an enlarged view showing the sprayer.

BEST MODE

Figure 1:
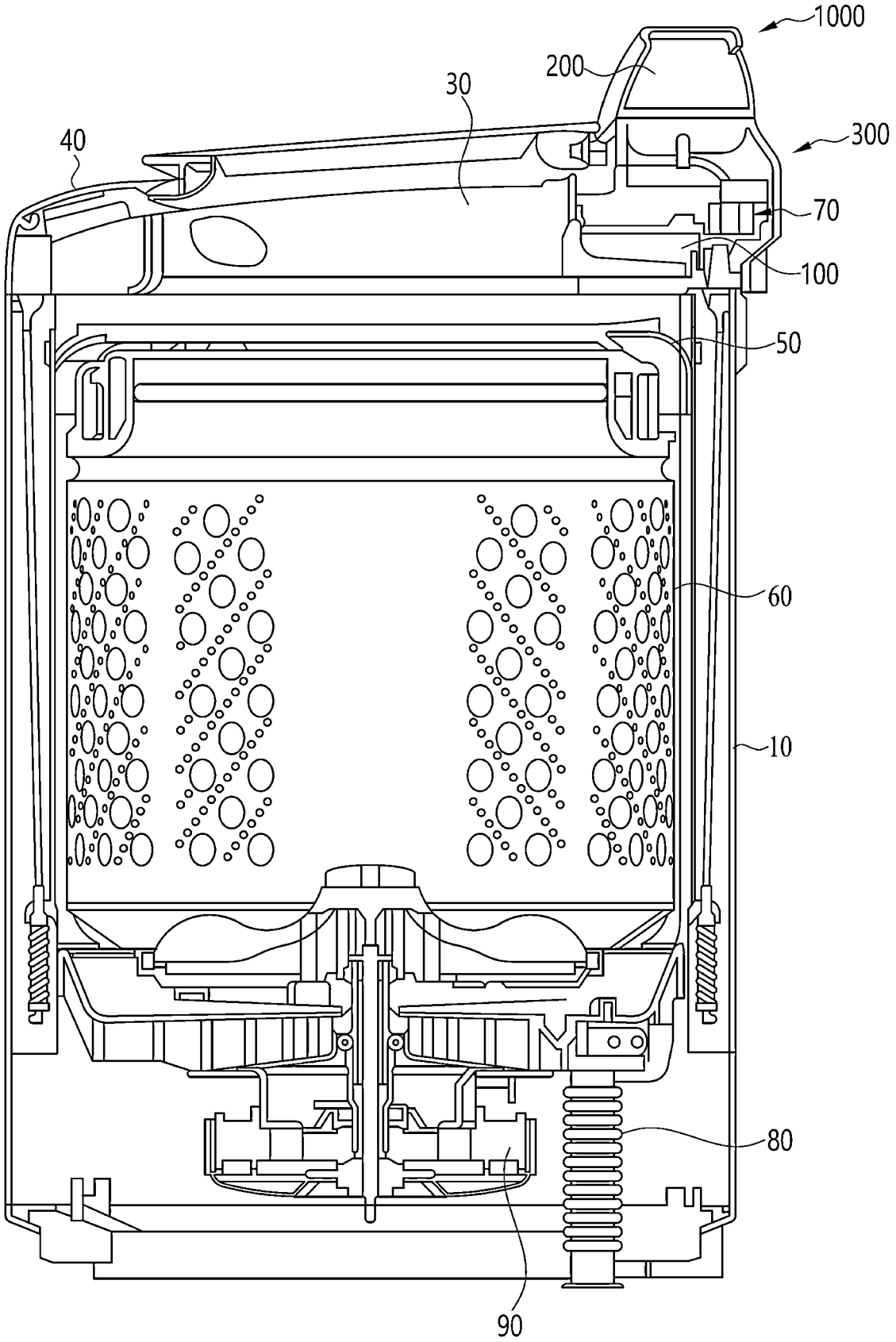
FIG. 1 illustrates a configuration of a laundry treating apparatus according to the present disclosure.

Hereinafter, exemplary embodiments will be described in detail with reference to the accompanying drawings. In the present specification, the same or similar reference numerals are assigned to the same or similar elements in different embodiments, and each of them will be described only once. As used herein, the singular forms "a", "an" and "the" include plural forms unless the context clearly indicates otherwise. In addition, in describing the embodiments disclosed herein, the detailed description of the related known technology may be omitted to avoid obscuring the subject matter of the embodiments. It should be noted that the accompanying drawings are merely provided to facilitate understanding of the embodiments disclosed in the present specification and are not to be construed as limiting the technical spirit disclosed in the present specification.

FIG. 1 illustrates a configuration of a laundry treating apparatus according to the present disclosure.

The laundry treating apparatus 1 of the present disclosure may be configured to perform any washing course to remove foreign matter from the clothing with water and detergent.

The laundry treating apparatus of the present disclosure may include a cabinet 10 defining an exterior, a tub 50 disposed inside the cabinet 10 to store water, a drum 60 rotatably disposed in the tub 50 to accommodate laundry (or clothing), and a drive part 90 coupled to the tub 50 and configured to rotate the drum 60.

The cabinet 10 may have an opening 21 at the top into which the clothing is loaded, and the tub 50 and the drum 60 may also each have an inlet at the top into which the clothing is loaded.

Further, the drive part 90 may be fixed to a bottom surface of the tub 50 to rotate the drum 60.

The laundry treating apparatus of the present disclosure may further include a suspension arranged inside the cabinet 10 to support the tub 50. The suspension may include a damper and a spring connecting the lower portion of the tub 50 to an inner upper portion of the cabinet 10.

The laundry treating apparatus of the present disclosure may include a water supply 70 arranged at the rear of the cabinet 10 to communicate with an external water source to supply water to the tub 50, and a drainage part 80 arranged to communicate with the lower portion of the tub 50 to drain water accommodated in the tub 50 to the outside of the cabinet 10.

The laundry treating apparatus of the present disclosure may include one or more of a manual detergent supply device 100 and an automatic detergent supply device 1000 configured to supply detergent to the tub 50.

The manual supply device 100 may allow a user to manually add detergent.

The manual supply device 100 may be arranged to communicate with the water supply 70 and the tub 50 to receive water supplied from the water supply 70, such that all of the detergent added is delivered to the tub 50. As a result, the manual supply device 100 is arranged to be supplied with an appropriate amount of detergent directly from the user each time the course is performed.

The automatic detergent supply device 1000 may be arranged to store a large amount of detergent to be supplied to the tub 50. In other words, the automatic detergent supply device 1000 may be arranged to store as much detergent as to perform the course multiple times such that an appropriate amount of detergent is discharged into the tub 50 each time the course is performed.

Unlike the manual detergent supply device 100, the automatic detergent supply device 1000 may be configured not to be supplied with water from the water supply 70. In other words, since the automatic detergent supply device 1000 is not supplied with water from the water supply 70, the water supplied to the water supply 70 may be prevented from fully discharging the detergent even when a large amount of detergent is stored.

The automatic detergent supply device 1000 may have a downstream portion connected to the water supply 70 or the tub 50, but an upstream portion thereof may communicate with the water supply 70.

The laundry treating apparatus of the present disclosure may include both the manual detergent supply device 100 and the automatic detergent supply device 1000, or may include only one of the devices.

When both the manual detergent supply device 100 and the automatic detergent supply device 1000 are provided, the manual detergent supply device 100 and the automatic detergent supply device 1000 may be arranged such that the downstream portions thereof communicate with each other. Thereby, the flow path structure may be simplified.

Figure 2:
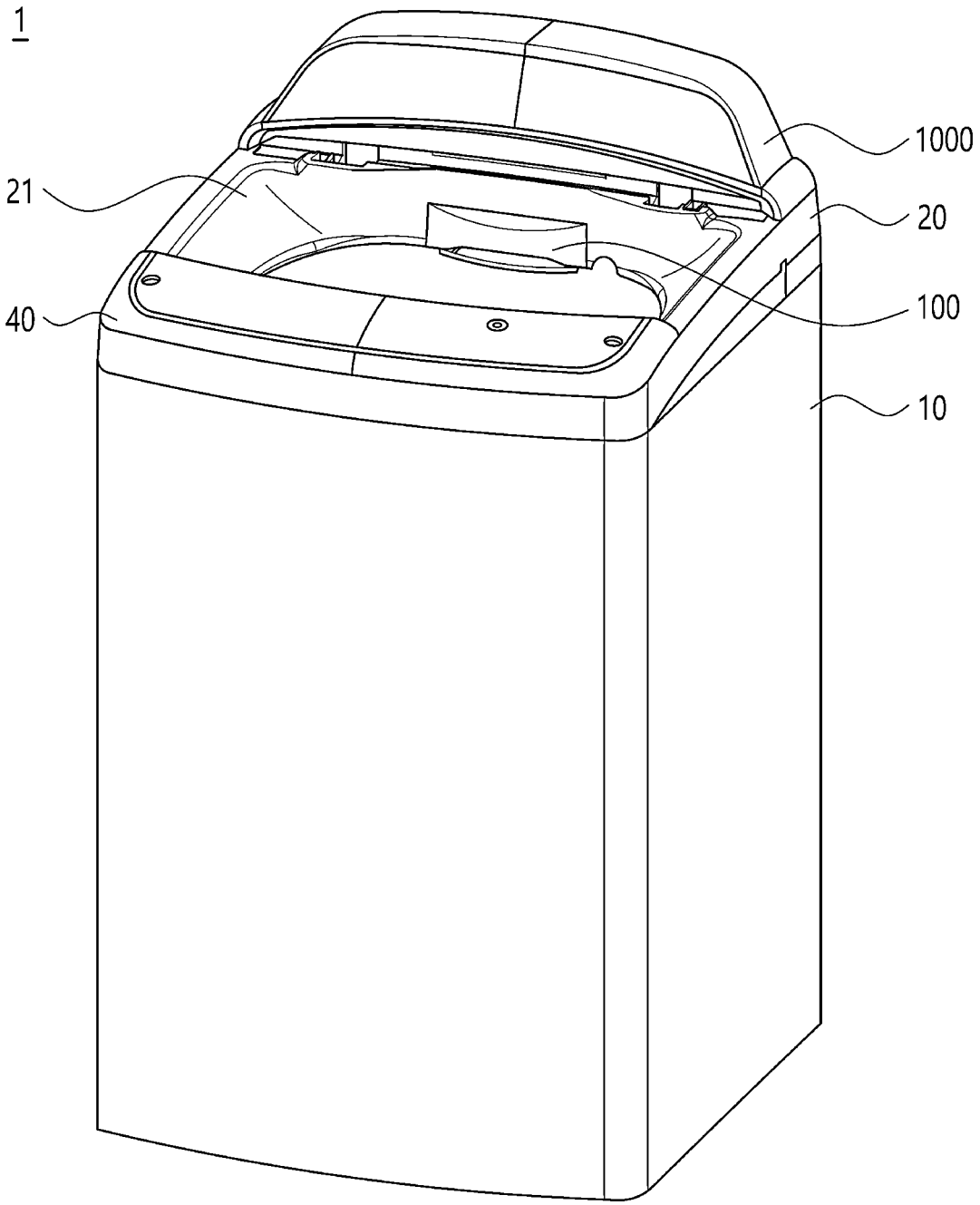
FIG. 2 shows an exterior of the laundry treating apparatus according to the present disclosure.

FIG. 2 shows an exterior of the laundry treating apparatus according to the present disclosure.

The laundry treating apparatus 1 of the present disclosure may include a top cover 20 coupled to an upper portion of the cabinet 10. The top cover 20 may define a top surface of the laundry treating apparatus 1 and may be provided with an opening 21 through which clothing is loaded.

The top cover 20 may be provided with a control panel 40 having an input part configured to receive a command to perform the course, and a display configured to externally display the status of the course being performed, the status of the automatic detergent supply device 1000, and the like.

The top cover 20 may be formed of a different material than the cabinet 10.

Thus, even when the cabinet 10 is formed of metal to ensure durability, the top cover 20 may be formed of resin or the like to provide a complex structure or to facilitate coupling of other components.

For example, a door 30 to open and close the opening 21 may be rotatably coupled to the top cover 20.

The automatic detergent supply device 1000 may store a larger amount of detergent as its volume increases, thereby reducing the number of times a user needs to refill the detergent.

Further, the automatic detergent supply device 1000 may be detachably attached to the laundry treating apparatus 1 of the present disclosure. Thus, the automatic detergent supply device 1000 may be easily cleaned by the user. Furthermore, the user may easily replace any unwanted detergent or foreign matter introduced.

Also, the suspension is not arranged at the corners of the cabinet 10, and the tub 50 is arranged adjacent to the cabinet 10 up to the inner upper end of the cabinet 10. Accordingly, there is insufficient space inside the cabinet 10 for the automatic detergent supply device 1000 to be installed in.

Therefore, the automatic detergent supply device 1000 may be disposed outside the cabinet 10, and may expand to have a sufficient volume without being constrained by the space in the cabinet 10.

The automatic detergent supply device 1000 may be coupled to the top cover 20 to be exposed to the outside. As a result, the automatic detergent supply device 1000 may be easily removed from and mounted to the top cover 20.

When the automatic detergent supply device 1000 is disposed in front of or on either side of the door 30 or the opening 21, the automatic detergent supply device 1000 may interfere with opening the door 30 and/or loading clothing into the opening 21.

Accordingly, the automatic detergent supply device 1000 may be disposed at the rear of the door 30 or the opening 21. Thereby, a user may open the door 30 or load the clothing into the opening 21 without being interfered with by the automatic detergent supply device 1000. Furthermore, the automatic detergent supply device 1000 may support the opened door 30, thereby preventing the door 30 from being excessively opened in the opening 21.

The drive part 90 is disposed under the tub 50. Accordingly, when the laundry treating apparatus of the present disclosure vibrates, the top cover 20 may vibrate the most. Since the automatic detergent supply device 1000 is capable of accommodating a large amount of detergent, it weighs a lot and is therefore subjected to a large inertia force. In such a situation, when the automatic detergent supply device 1000 is detachably coupled to the upper portion of the top cover 20, the automatic detergent supply device 1000 of the laundry treating apparatus is subjected to the highest amplitude vibration. Thus, the automatic detergent supply device 1000 is likely to be unintentionally detached from the top cover 20.

Therefore, the automatic detergent supply device 1000 may be fully accommodated in a housing provided in the top cover and may have a drawer type form that is withdrawable outwardly from one side of the housing.

However, when the automatic detergent supply device 1000 is provided as a drawer type while being coupled to the rear of the door 30 of the top cover 20, the direction in which the automatic detergent supply device 1000 is withdrawn from the housing may correspond to any one of the top, side, or front.

Since the top-loading type washing machine is formed to have a height greater than a width thereof in order to secure a washing capacity, it is very difficult for a user to withdraw and insert the automatic detergent supply device 1000 from and into the housing of the top cover 20 in a vertical direction. Furthermore, since the automatic detergent supply device is disposed at the rear of the door 30, it may be very difficult for the user to withdraw and insert the automatic detergent supply device 1000 from and into the housing of the top cover 20 in the vertical direction.

Further, it may be easier for the user to withdraw and insert the automatic detergent supply device when the automatic detergent supply device is arranged to be laterally withdrawn from and inserted into the housing of the top cover 20 than when it is arranged to be withdrawn and inserted in the vertical direction.

However, in order for the entire automatic detergent supply device to be withdrawn from the housing, space allowing the automatic detergent supply device to be withdrawn laterally as far as the length of the automatic detergent supply device is needed. Accordingly, if the space in which the laundry treating apparatus is arranged is narrow and thus the distance by which the automatic detergent supply device can be withdrawn is not secured, the user cannot use the automatic detergent supply device.

When the automatic detergent supply device is arranged to be withdrawn from and inserted into the top cover 20 in a front-back direction, the distance by which the automatic detergent supply device is withdrawn may always be secured.

However, in order for the automatic detergent supply device to be coupled to the housing to communicate with the tub, a pump or hose to be coupled to the automatic detergent supply device to communicate with the automatic detergent supply device needs to be provided on the back side of the housing facing the side into which the automatic detergent supply device is inserted.

Therefore, additional space where the pump and/or hose is to be installed should be provided on the back side of the door 30 and the inlet because the automatic detergent supply device should be disposed ahead of the pump or hose. As a result, a sufficient volume of the automatic detergent supply device may not be secured. If the length in the insertion/withdrawal direction is extended sufficiently to secure the volume of the automatic detergent supply device, the area of the opening 21 may be reduced. As a result, it may become difficult to insert and withdraw clothing, or the opening 21 and the door 30 may be disposed with an excessive forward bias with respect to the top cover 20, causing an imbalance due to preferential loading of clothing only in the front of the drum 60.

As a result, for a top-loading type washing machine such as the laundry treating apparatus of the present disclosure, it is not preferable to configure the automatic detergent supply device 1000 as a drawer type.

Therefore, the automatic detergent supply device 1000 of the laundry treating apparatus of the present disclosure may be configured to be mounted on the top of the top cover 20, such that it is exposed to the outside.

As a result, in the laundry treating apparatus of the present disclosure a direction in which the automatic detergent supply device 1000 is mounted to or detached from the top cover 20 is less restricted than in the case of the drawer type, while securing a degree of freedom. Further, it is allowed to extend at least one of a sufficient height, width, or length of the automatic detergent supply device.

Figure 3:
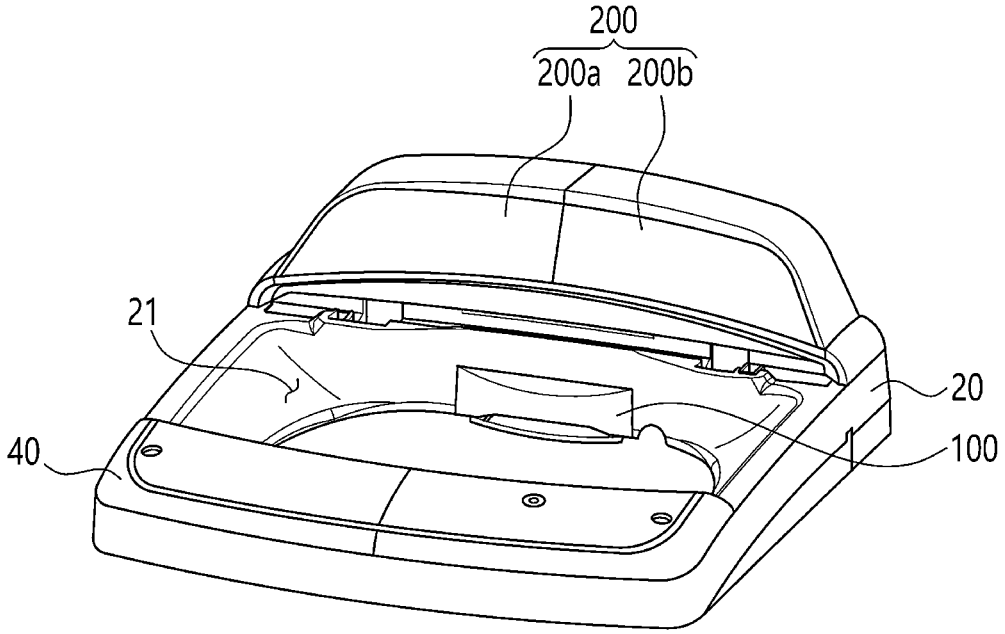
FIG. 3 shows a structure of the top cover of the laundry treating apparatus according to the present disclosure.

FIG. 3 shows a structure of the top cover of the laundry treating apparatus according to the present disclosure.

The automatic detergent supply device 1000 of the laundry treating apparatus of the present disclosure may be disposed on the top cover 20.

The top cover 20 may be formed of a plastic material and may be readily molded into a structure on which the automatic detergent supply device 1000 may be seated.

The water supply 70 may be installed on the rear surface of the top cover 20. The manual supply device 100 may be disposed at a rear lower portion of the opening 21 formed through the top cover 20.

The manual supply device 100 may be forwardly withdrawable from the top cover 20 to receive a powdered detergent or liquid detergent. The manual supply device 100 may be configured to communicate with the water supply 70 to receive water and discharge the loaded detergent downward.

Since the inlet of the tub 50 is disposed below the opening 21, the detergent discharged from the manual supply device 100 may be delivered directly into the tub 50.

The manual supply device 100 may include a drawer 130 that is withdrawable forwardly from the opening 21. Thus, the drawer may be withdrawn forward only when detergent is being loaded, and at other times may remain accommodated in the top cover 20 so as not to interfere with the clothing being loaded.

The automatic detergent supply device 1000 may be disposed on the rear upper portion of the top cover 20. The automatic detergent supply device 1000 may be disposed above the water supply 70, and may be disposed above the manual detergent supply device 100.

Thus, the detergent discharged from the automatic detergent supply device 1000 may be delivered to the water supply 70 or the manual detergent supply device 100 so as to be supplied to the tub 50.

The automatic detergent supply device 1000 may include a storage part 200 (a cartridge) configured to store the detergent supplied to the tub 50, and a mounting part 300 configured to secure the storage part 200 to an upper portion of the top cover 20.

The storage part 200 may be detachably attached to the mounting part 300. Thus, the storage part 200 may be detached from the mounting part 300 when necessary, which may facilitate cleaning/maintenance.

Further, the storage part 200 may be detached from the mounting part 300 for a user to supply detergent to the storage part 200. This may allow the user to supply the detergent to the storage part 200 without being restricted to a location, and prevent contamination of the top cover 20 or the like during the process of supplying the detergent to the storage part 200.

A plurality of storage parts 200 may be provided to store different detergents. The plurality of the storage parts 200 may be mounted on the mounting part 300 along the width direction of the top cover 20.

The mounting part 300 may be disposed on a rear portion of the top cover 20 in the width direction of the top cover 20. The mounting part 300, which may be integrated with the top cover 20, may be mounted on the top cover 20 at the rear of the door 30.

The mounting part 300 may be configured to allow the storage part 200 to be mounted thereon, and the storage part 200 may be configured such that the lower portion thereof is secured to the mounting part 300.

The storage part 200 may be coupled to and detached from the mounting part 300 while exposed to the outside of the top cover 20. Thus, the direction in which the storage part 200 is coupled to or detached from the mounting part 300 is not fixed to a particular direction, and may thus allow the user to couple and detach the storage part 200 to and from the mounting part 300 without being significantly interfered with by the height of the cabinet 10.

The overall length of the storage part 200 may be greater than the height or thickness of the storage part 200. Thus, the center of gravity of the storage part 200 may be lowered and the area of the door 30 or the opening 21 may be ensured, while increasing the detergent storage capacity of the storage part 200.

The mounting part 300 may be provided with a conveying part to receive the detergent from the storage part 200 and discharge the same to the tub 50. The conveying part may include a detergent pump configured to discharge the detergent from the storage part 200, and a detergent supply pipe allowing the detergent pump to communicate with at least one of the water supply 70, the tub 50, or the manual detergent supply device 100 therethrough.

Figure 4:
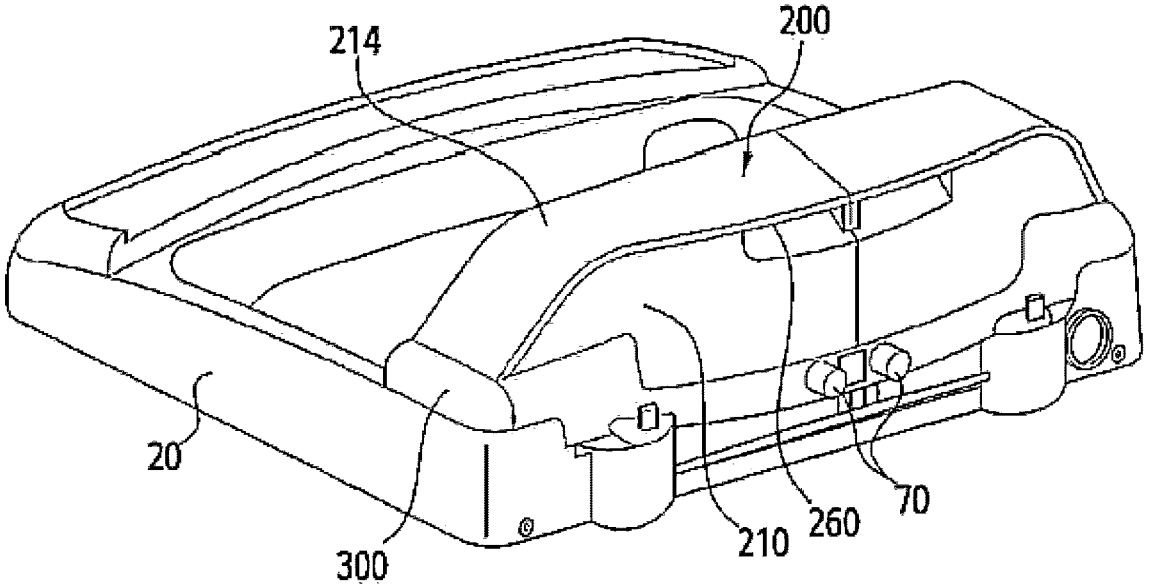
FIG. 4 is a rear perspective view showing an automatic detergent supply device according to the present disclosure.

FIG. 4 is a rear perspective view showing an automatic detergent supply device according to the present disclosure.

With reference to FIG. 4, the storage part 200 and mounting part 300 disposed on the rear portion of the top cover 20 will be described.

The storage part 200 may include a first storage part 200*a* (a first cartridge) detachably coupled to the mounting part 300 to store a first detergent, and a second storage part 200*b* (a second cartridge) provided separately from the first storage part 200*a* and detachably coupled to the mounting part 300 to store a second detergent.

The first detergent may be a laundry detergent necessary to remove foreign matter from the clothing, and the second detergent may be a bleaching agent to bleach the clothing or a softener to control the stiffness and fragrance of the fibers.

The first detergent and the second detergent may be provided in liquid form and may be easily discharged into the mounting part 300 by their own weights.

The manual detergent supply device 100 may be configured to store a third detergent. The third detergent may be a separate detergent different from the first and second detergents, or may be the same as the first and second detergents but in powdered form.

Of course, the third detergent may be completely identical to one of the first and second detergents.

The first storage part 200*a* and the second storage part 200*b* may have the same shape and be arranged symmetrical to each other with respect to the surfaces thereof facing each other, or may have shapes completely different from each other.

However, the first storage part 200*a* and the second storage part 200*b* may have the same function in structure and may be detachably attached to the mounting part 300 in the same manner.

Therefore, the structure, coupling, and residual detergent discharge method of the storage part 200 and the mounting part 300 will be described below based on the first storage part 200*a*, which is merely intended to avoid redundant description. The same description may be applied to the second storage part 200*b*.

The storage part 200 may include a storage body 210 that provides a space for storing detergent, and a cover door 214 that shields an upper surface of the storage body 210 may be rotatably coupled thereto. The storage part 200 may be positioned at a top rear portion of the top cover 20 and exposed to the user.

The storage body 210 may be partially or fully formed of a transparent material. The transparent portion of the storage body 210 allows the user to view the remaining amount of the laundry detergent accommodated in the storage body 210.

The cover door 214 covers the top of the storage body 210. An opening is formed in the top of the storage body 210. The cover door 214 opens and closes the opening of the storage body 210. The laundry agent is accommodated in the storage space through the opening of the storage body 210. A user may open the cover door 214, fill the storage space of the storage body 210 with the laundry detergent, and close the cover door 214 to close the storage space.

According to an embodiment of the present disclosure, a push portion 260 may be formed at the rear of the storage part 200. The push portion 260 may be formed by recessing the rear of the storage body 210. For example, the push portion 260 may be formed by a combination of the cover door 214 and the recessed portion of the storage body 210. The push portion 260 may include a portion of the cover door 214 exposed by the recessed portion of the storage body 210. A user may hold the bottom surface of the exposed portion of the cover door 214 with a hand and lift the storage part 200 upward to detach the storage part 200 from the mounting part 300. As the push portion 260 is positioned at the rear of the storage part 200, the user may pull the storage part 200 toward the user's body while lifting the storage part 200 upward, and the storage part 200 may be reliably detached. As an example, when the storage part 200 is detached, the storage part 200 may be prevented from falling rearward of the laundry treating apparatus 1.

FIG. 5 illustrates an embodiment of attachment and detachment of a storage part to and from a mounting part according to the present disclosure.

The storage part 200 may be attached to and detached from the mounting part 300 in the height direction of the cabinet 10. In other words, the storage part 200 may be coupled to the mounting part 300 in a vertically pluggable manner.

The first storage part 200*a* and the second storage part 200*b* are detachable. As the storage part 200 is detachable from the mounting part 300, a user may conveniently refill the storage part 200 with laundry detergent. In addition, the storage part 200 may be conveniently cleaned.

The cover door 214 may be hingedly coupled to the storage body 210. A hinge coupling portion 2116 may be pivotably provided at a rear top of the body 210. The hinge coupling portion 2116 may be provided at the push portion 260.

The push portion 260 may be formed in a shape inwardly recessed in the storage body 210. The hinge coupling portion 2116 may be provided on the sidewall formed by the recess. The cover door 214 may pivotally rotate around the hinge coupling portion 2116.

As the hinge coupling portion 2116 is positioned at the rear of the storage body 260, the cover door 214 pivots reward to open. Thus, when a user detaches the storage part 200 from the mounting part 300 while holding the push portion 260, the cover door 214 may be prevented from opening.

The mounting part 300 defines the rear top surface of the top cover 20. The mounting part 300 is formed in a shape corresponding to the bottom surface of the storage part 200.

FIG. 6 illustrates another embodiment of attachment and detachment of the automatic detergent supply device to and from the laundry treating apparatus of the present disclosure.

The storage body 210, according to one embodiment, may be coupled and decoupled by sliding on the mounting part 300 along the width direction of the top cover 20.

The storage body 210 does not need to be lifted from the mounting part 300 when detached from the mounting part 300, and does not need to be lifted to the top of the mounting part 300 when coupled to the mounting part 300. Thus, even though the storage body 210 is mounted on the top of the top cover 20 at the rear of the top cover 20, the user is allowed to easily attach and detach the storage body 210 to and from the mounting part 300.

Further, the storage body 210 may be attached to the mounting part 300 by being pushed or pulled from a side of the mounting part 300. Thus, the storage body 210 may be slidably attached and detached to and from the mounting part 300 at the rear of the door 30, even when the door 30 is in the open position of the opening 21.

Once the storage body 210 is detached by moving laterally from the mounting part 300, the storage body 210 is then allowed to freely move not only laterally on the mounting part 300, but also upwards, forwards, backwards, and so on.

In other words, the storage body 210 may be detached from the mounting part 300 even when the inner surface of the storage body 210 does not move up to the outer side of the mounting part 300. For example, the storage body 210 may be completely detachable from the mounting part 300 once the storage body 210 and the mounting part 300 are decoupled in terms of fluidic communication. Thus, the storage body 210 may continue to move to the side of the mounting part 300 while supported on the mounting part 300, or it may be lifted from the mounting part 300 in all directions except the downward direction to be detached from the mounting part 300.

As a result, the storage body 210 may be detached from the mounting part 300 even when a wall or other appliance or the like is placed on a lateral outer surface of the top cover 20 or a lateral outer surface of the mounting part 300 and thus a space allowing the storage body 210 to slide a distance corresponding to the length of the storage body 210 is not secured.

When the storage body 210 is coupled to the mounting part 300, the operations of the method described above may be performed in reverse order.

The mounting part 300 may include a communication passage 370 that is detachably coupled to the storage body 210. The storage body 210 may be detachably coupled to the communication passage 370 and may be configured to discharge the stored detergent into the communication passage 370.

The communication passage 370 may be configured to protrude from the mounting part 300 in a width direction of the top cover 20. Thereby, the storage body 210 may be moved in the width direction of the top cover 20 to be coupled to the communication passage 370.

The mounting part 300 may allow the storage body 210 to slide on the top of the mounting part 300 until the storage body 210 is completely decoupled from the mounting part 300.

However, the storage body 210 may slidably move on the mounting part 300 when it is coupled to the communication passage 370. When it is released from the communication passage 370, the storage body may be completely decoupled without slidably moving on the mounting part 300.

As a result, the storage body 210 may slide on the top of the mounting part 300 in the width direction of the top cover 20 to be coupled to and decoupled from the mounting part 300. However, the storage body 210 may be supported and slidable on the top of the mounting part 300 on when the storage body 210 is fluidly coupled to and decoupled from the mounting part 300. In other words, when the storage body 210 is released from the fluidic coupling with the mounting part 300, the storage body 210 may be allowed to freely move on the top of the mounting part 300 regardless of the shape of the mounting part 300.

The mounting part 300 may include a mounting groove 310 that accommodates and supports at least a portion of the lower portion of the storage body 210.

The lower surface of the storage body 210 may be supported on both side surfaces of the mounting groove 310 and be guided to slide while accommodated in the mounting groove 310.

One end or inner side of the mounting groove 310 may be provided with a restriction surface 320 that restricts inward movement or insertion of the storage body 210.

The restriction surface 320 may support the storage body 210 to prevent the storage body 210 from vibrating inwardly.

The communication passage 370 may protrude outward from the restriction surface 320. The communication passage 370 may be disposed closer to a lower portion of the restriction surface 320 than to an upper portion of the restriction surface 320.

When the storage part 200 is decoupled from or coupled to the mounting part 300, the laundry agent may leak through the communication passage 370 and pool in the mounting groove 310. Accordingly, it is necessary to remove the leaked laundry agent. To this end, the mounting part 300 may include a drain 390 for draining any laundry agent or residual water present in the mounting groove 310 into the tub 50. A detailed structure of the drain 390 will be described later.

Once the storage part 200 is secured to the mounting part 300, it is necessary to prevent the storage part 200 from being unintentionally detached from the mounting part 300. In other words, the ease with which the storage part 200 slides along the mounting groove 310 to be attached to and detached from the mounting part 300 means that the storage part 200 can be easily detached from the mounting part 300.

Since the laundry treating apparatus of the present disclosure is configured as a top-loading type washing machine, more vibration is generated in the mounting part 300. Therefore, the mounting part 300 may be configured to facilitate coupling of the storage part 200 to the mounting part 300, but to make detachment and relative vibration of the storage part difficult.

To this end, the mounting part 300 may further include a bump 330 that prevents the storage body 210 from being withdrawn or sliding outward once the storage body 210 is coupled to the communication passage 370 or completely mounted on the mounting part 300.

The bump 330 may protrude from the opposite end or outer side of the mounting groove 310.

FIG. 7 is a perspective view showing the mounting part of the laundry treating apparatus of the present disclosure, and FIG. 8 is a top view showing the mounting part.

According to one embodiment, the storage body 210 may be coupled to and decoupled from the mounting part 300 by sliding in the width direction of the top cover 20.

In this case, the mounting part 300 may include a mounting body 301 disposed widthwise of the top cover 20 on the top of the top cover 20 to support the storage part 200, and a mounting groove 310 recessed in the mounting body 301 to accommodate and support a lower portion of the storage part 200.

The mounting groove 310 may extend widthwise from the mounting body 301 to guide the slide movement of the storage part 200, and may accommodate a portion of the lower portion of the storage part 200 to support or anchor the storage part 200 in a front-to-back direction.

The mounting part 300 may include a restriction surface 320 that extends upwardly stepwise from an inner side of the mounting groove 310 to prevent the storage part 200 from moving further inwardly, and may also include a communication passage 370 provided on the restriction surface 320 and detachably coupled to the storage part 200. The communication passage 370 may be configured to be at least partially inserted into the storage body 201 to receive detergent accommodated in the storage part 200. That is, the communication passage 370 may be arranged to communicate with the storage part 200.

The communication passage 370 may protrude from the restriction surface 320 toward the opposite end of the mounting groove 310 or the outside. The restriction surface 320 may support an inner surface or a portion of a lower surface of the storage body 210 to prevent the storage part 200 from vibrating toward the inner side of the restriction surface 320.

The mounting part 300 may include accommodation ribs 340 provided on both sides with respect to the direction in which the storage part 200 slides in the mounting groove 310, or at the front or rear with respect to the top cover 20 to support the storage part 200.

The accommodation rib 340 may extend from one end or inner side of the mounting groove 310 toward the opposite end or outer side, and may protrude upward from the mounting body 301 to accommodate at least a portion of the lower portion of the storage part 200.

The accommodation ribs 340 may protrude higher than the bottom surface of the mounting groove 310 and may extend outward from the upper end of the restriction surface 320.

The mounting part 300 may include a bump 330 that protrudes outward from the outer side or opposite end of the mounting groove 310 to prevent withdrawal of the storage part 200. The accommodation ribs 340 may extend from the restriction surface 320 to the bump 330.

The accommodation ribs 340 may support both sides of the storage part 200 to guide the storage part 200 as it slides inwardly and outwardly of the mounting groove 310.

The bump 330 may be arranged to face the restriction surface 320, and may prevent the storage part 200 from vibrating outwardly beyond the bump 330.

Accordingly, the mounting groove 310 may be defined by the accommodation ribs 340, the bump 330, and the restriction surface 320 protruding from the mounting body 301, rather than being recessed in the mounting body 301.

The mounting groove 310 may fully accommodate the lower portion of the storage part 200 to securely support the storage part 200, or may accommodate a portion of the protruding surfaces of the lower portion of the storage part 200 to securely support the storage part 200.

The outer surface of the bump 330 may be provided with a fastening portion 334 to detachably engage with the storage part 200. The fastening portion 334 may be provided as a recess in the outer surface of the bump 330 to detachably engage with a hook provided on the storage part 200.

The mounting part 300 may secure the lower portion of the storage part once the storage part is mounted in the mounting groove 310.

Once the storage part 200 is coupled to the communication passage 370, the restriction surface 320 and the bump 330 may secure the storage part 200 so as not to vibrate or further move in the width direction.

Once the storage part 200 is coupled to the communication passage 370, the accommodation ribs 340 may secure the storage part 200 so as not to vibrate or further move in the front-to-back direction.

The mounting part 300 may accommodate or support four surfaces of the lower portion of the storage part 200 to prevent the storage part 200 from being unintentionally detached from the mounting part 300.

When the storage part 200 is coupled to the communication passage 370, the fastening portion 334 provided in the bump 330 may be detachably coupled to the storage part 200 to further secure the storage part 200.

The mounting part 300 may further support the lower portion of the storage part 200 using a lateral step 350 disposed outside of the accommodation rib 340, a support surface 380 disposed inside of the restriction surface 320, and an outer step 360 disposed outside of the bump 330.

Thus, once the storage part 200 is seated, the mounting part 300 may secure the storage part 200, thereby preventing the storage part 200 from being unintentionally detached and preventing the storage part 200 from vibrating to any of the four sides.

The mounting groove 310 may be provided with a drain 390 in communication with the tub 50. Thus, fluid such as detergent or water remaining in the mounting groove 310 may be discharged to the tub 50 through the drain 390.

The fluid may be discharged directly to the tub 50 through the drain 390, or may be discharged via a connector 400, which will be described later.

The communication passage 370 may be provided on the restriction surface 320, and the drain 390 may be provided in the bottom surface of the mounting groove 310. Thereby, the laundry agent stored in the storage part 200 may be delivered to the tub 50 through the communication passage 370, and the fluid remaining in the mounting groove 310 may be discharged to the tub 50 through the drain 390.

Thus, the hygiene of the laundry treating apparatus may be improved by removing any laundry agent or residual water remaining in the mounting groove 310 by discharging the same to the tub 50 through the drain 390.

Alternatively, when the storage part 200 is attached to and detached from the mounting part 300 in a height direction of the cabinet 10, the bottom surface of the mounting groove 310 may be provided with both the communication passage 370 and the drain 390.

Figure 9:
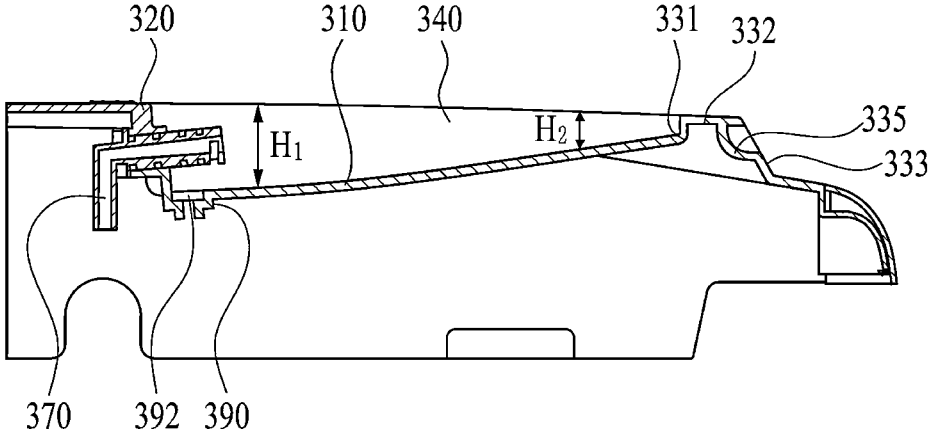
FIG. 9 is a cross-sectional view showing the mounting part.

FIG. 9 is a cross-sectional view showing the mounting part.

The mounting groove 310 may be inclined downward toward the drain 390 to more easily discharge detergent remaining in the mounting groove 310 through the drain 390.

The depth H1 of the mounting groove 310 at a position adjacent to the communication passage 370 or the drain 390 may be greater than the depth H2 of the mounting groove 310 at a position adjacent to the bump 330.

Further, the mounting part 300 may be disposed such that the mounting groove 310 is inclined in the width direction of the top cover.

Thus, the fluid such as laundry agent or water remaining in the mounting groove 310 may be easily discharged through the drain hole 391 provided in the drain groove 392 by gravity.

The mounting groove 310 may be provided with a slope that decreases in height from the bump 330 to the restriction surface 320. The mounting groove 310 may be configured to decrease in height from the opposite end or outer side to the one end or inner side such that the storage part 200 seated in the mounting groove 310 may slidably move by gravity toward the communication passage 370.

Furthermore, when the storage part 200 is seated in the mounting groove 310, gravity may act toward the communication passage 370, which may facilitate delivery of the laundry agent provided in the storage part 200 to the communication passage 370 by gravity, and prevent the storage part 200 from sliding out of the mounting groove 310 in the opposite direction.

The lower portion of the storage part 200 may be disposed to have an inclination corresponding to that of the mounting groove 310 such that the center of gravity is further skewed toward the restriction surface 320.

Thus, even when the storage part 200 is subjected to vibration in the width direction, the restriction surface 320 or the communication passage 370 may support the load of the storage part 200 while preventing the storage part 200 from moving out of the mounting groove 310.

The mounting part 300 may further include a drain groove 392 formed by recessing a portion of the mounting groove 310, and the drain groove 392 may have the drain hole 391 formed therein.

In the process of coupling or decoupling the communication passage 370 to or from the storage part 200, the laundry agent may leak out. The leaked laundry agent may remain in the mounting groove 310. The residual laundry agent may be deposited to form contaminants, and accordingly the user may need to clean the deposited contaminants. After the user cleans the deposits, any residual water remaining in the mounting groove 310 or the drain groove 392 is discharged into the tub 50 through the drain hole 391.

According to one embodiment of the present disclosure, the residual water remaining after cleaning the residual laundry agent and its surroundings may be easily discharged through the drain hole 391, and the laundry agent deposited by the drain groove 392 or residual water does not spread to other components, which may facilitate cleaning and maintenance.

Figure 10:
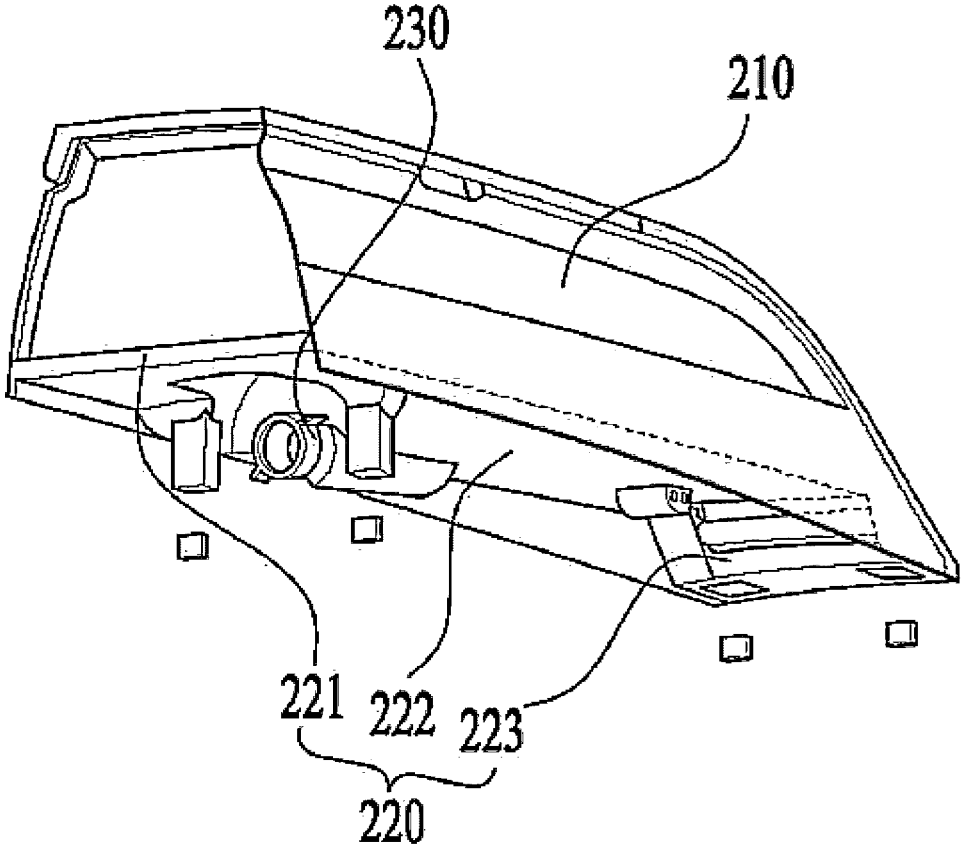
FIG. 10 shows a detailed structure of the storage part according to an embodiment.

FIG. 10 shows a detailed structure of the storage part according to an embodiment.

The storage part 200 may include a storage body 210 configured to receive and store detergent, and a plate 220 that is provided on a lower portion of the storage body 210 and may be mounted in the mounting groove 310.

The plate 220 defines the lower portion of the storage part 200. The plate 220 may be integrated with the storage body 210, or may be coupled to a lower portion of the storage body 210.

The plate 220 may be detachably mounted to the mounting part 300, and may be secured to the mounting part 300. The storage body 210 may be stably secured to the mounting part 300 by the plate 220.

The plate 220 may include a discharge portion 230 detachably coupled to the communication passage 370 at one side or the bottom thereof to discharge detergent.

The discharge portion 230 may be disposed closer to the one end or inner side than to the opposite end or outer side of the plate 220.

Specifically, in the case where the storage part 200 is attached to and detached from the mounting part 300 in a widthwise direction of the cabinet 10, the discharge portion 230 may be provided on the inner side of the storage body 210. In the case where the storage part 200 is attached to and detached from the mounting part 300 in a height direction of the cabinet 10, the discharge portion 230 may be provided on the plate 220.

The discharge portion 230 may be provided with a check valve to discharge detergent from the storage body 210 only when coupled to the communication passage 370.

The plate 220 may include a lower surface 222 defining the bottom surface of the storage body 210 to move the detergent to the discharge portion 230.

The bottom surface 222 may be provided with a slope that decreases in height from the opposite end or outer side of the storage body 210 to the one end or inner side. In other words, the bottom surface 222 may be provided with a slope that decreases in height as it extends towards the discharge portion 230, thereby guiding discharge of the detergent from the storage body 210 to the discharge portion 230 and preventing the retention of the detergent inside the storage body 210.

Both the storage body 210 and the plate 220 may be accommodated and supported in the mounting groove 310.

However, once the entire the storage part 200 is accommodated in the mounting groove 310, it may be easy to support and secure the storage part in the mounting groove 310 but very difficult to withdraw the storage part.

Therefore, only a portion of the storage part 200 may be accommodated in the mounting groove 310 and the other portion thereof may be disposed on the outside of the mounting groove 310 to facilitate removal from the mounting part 300.

To this end, the plate 220 and the storage body 210 may be configured to be longer than the width of the mounting groove 310 such that a portion thereof is disposed on the outside of the mounting groove 310.

The plate 220 may include a coupling surface 223 extending from the bottom surface 222 to the other end or outer side. The coupling surface 223 may be disposed on the outside of the mounting groove 310, and may be supported on an outer surface of the bump 330.

As the discharge portion 230 is supported on the communication passage 370, and the coupling surface 223 is supported on the bump 330, the storage part 200 may be prevented from moving or vibrating further inwardly of the mounting groove 310.

FIG. 11 shows the structure of a manual detergent supply device of the laundry treating apparatus according to the present disclosure.

The manual detergent supply device 100 may be configured to allow a user to manually add detergent. The manual detergent supply device 100 may be provided in the top cover 20 to communicate with the tub 50 and store detergent.

The manual detergent supply device 100 is arranged to communicate with the water supply 70 and the tub 50. Thus, it receives water supplied by the water supply 70 and supplies the same to the tub 50. As a result, all of the detergent input is supplied to the tub 50. As a result, the manual detergent supply device 100 is configured to directly receive an appropriate amount of detergent supplied by the user each time the course is performed.

The manual detergent supply device 100 may include a drawer 130 withdrawable forwardly out of the opening 21. Thus, the manual detergent supply device is withdrawn forward only when detergent is loaded, and remains accommodated in the top cover 20 in other times so as not to interfere with the loading of the clothing.

The drawer 130 may be provided with a second body 120 into which a user may load a first detergent or a second detergent. Since the water supplied through the water supply 70 passes through the second body 120, the detergent provided in the drawer 130 may be supplied into the tub 50 due to water pressure.

Further, the manual detergent supply device 100 may include a first body 110 configured to accommodate the second body 120 and the drawer 130 and define the exterior of the manual detergent supply device 100.

The top surface of the first body 110 may have a water inlet hole 111 through which water supplied from the water supply 70 flows into the manual detergent supply device 100, a residual water hole 112 into which residual water flows, and a detergent hole 113 into which detergent discharged from the automatic detergent supply device 1000 flows.

The laundry treating apparatus 1 may further include a connector 400 extending from the drain 390 through which the fluid flows in order to remove any fluid, such as laundry agent, remaining in the mounting groove 310.

Hereinafter, embodiments of the connector 400 for discharging the fluid into the tub 50 will be described.

FIG. 12 is a cross-sectional view showing a connector according to an embodiment of the present disclosure, and FIG. 13 shows a detailed structure of the connector according to the embodiment of the present disclosure.

According to one embodiment of the present disclosure, in the laundry treating apparatus, one end of the connector 400 may be connected to the drain 390 and the opposite end of the connector 400 may be connected to the manual detergent supply device 100 to discharge the fluid into the tub 50.

One end of the connector 400 may be formed by an extension of the drain groove 392, or may be configured to surround an outer circumferential surface of the drain groove 392. The connector 400 may be connected in such a way that the fluid discharged from the drain hole 391 does not leak.

According to one embodiment of the present disclosure, the connector 400 may include a hose allowing the fluid to flow into the tub 50 therethrough.

A first connector 410 according to one embodiment of the present disclosure may be connected at its opposite end to the manual detergent supply device 100. It may include a hose. Specifically, the opposite end of the first connector 410 may be connected to the residual water hole 112 provided in the top surface of the first body 110 such that the fluid may move to the tub 50 through the manual detergent supply device 100.

The first connector 410 is provided with an elastic hose. Accordingly, even when the drain 390 and the residual water hole 112 are not arranged to face each other, the fluid may be allowed to flow by connecting the drain 390 and the manual detergent supply device 100, avoiding the complex structure inside the top cover 20.

Figure 14:
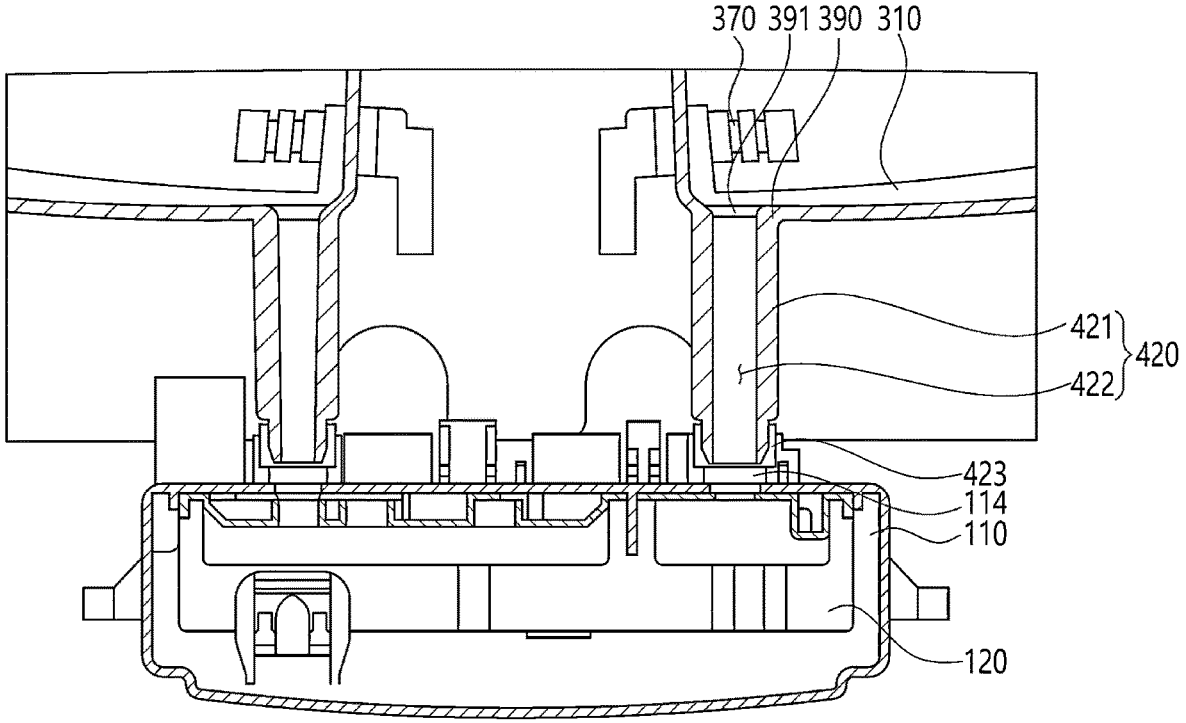
FIG. 14 shows a connector according to another embodiment of the present disclosure.
Figure 15:
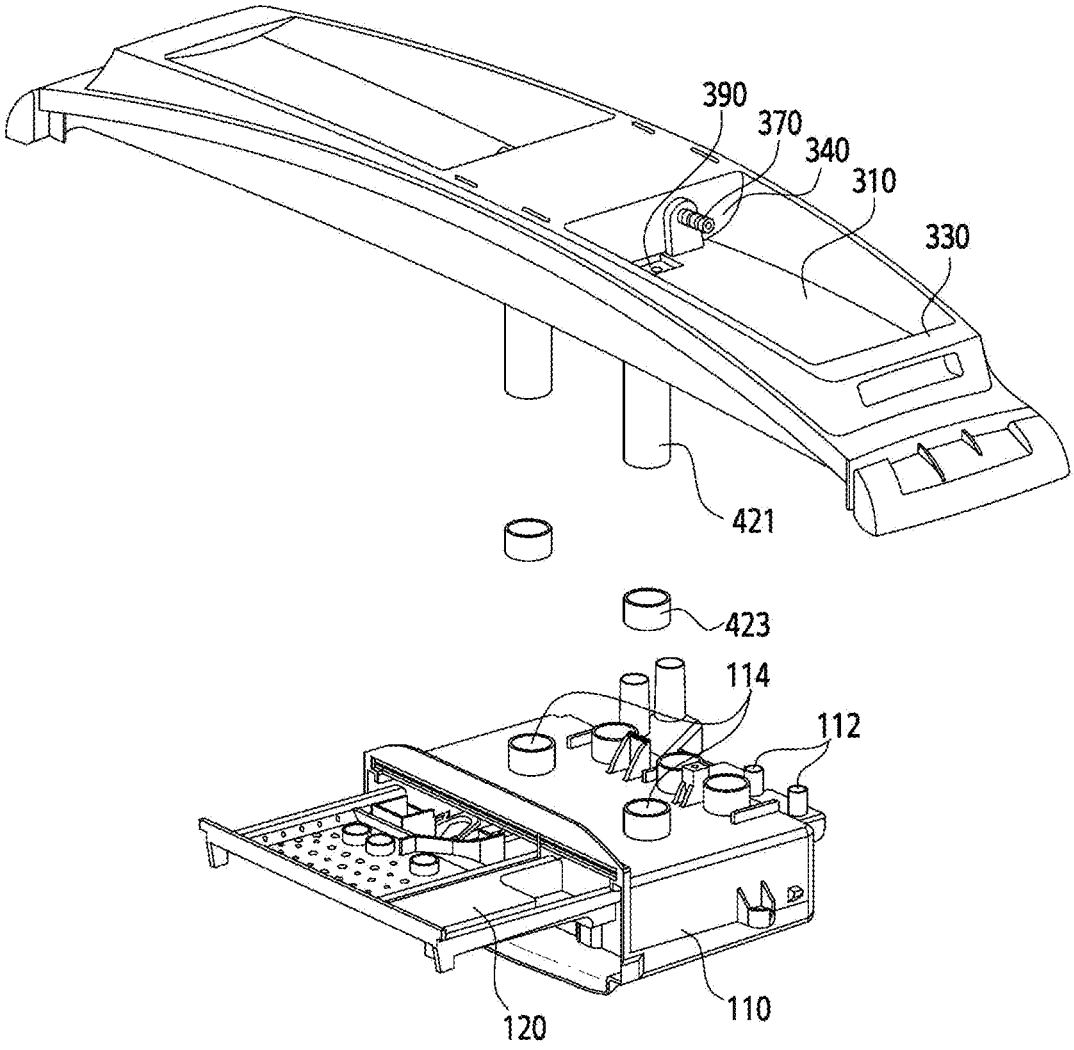
FIG. 15 shows a detailed structure of the connector according to the embodiment of the present disclosure.

FIG. 14 is a cross-sectional view showing a connector according to one embodiment of the present disclosure, and FIG. 15 shows a detailed structure of the connector according to the embodiment of the present disclosure.

According to one embodiment of the present disclosure, a laundry treating apparatus may be provided in which the opposite end of the connector 400 is connected to the wash hole 114.

A second connector 420 according to one embodiment of the present disclosure may include a rigid body having one end connected to the drain 390 and an opposite end connected to the manual detergent supply device 100. Specifically, the opposite end of the second connector 420 may be connected to the wash hole 114 provided in the top surface of the first body 110 such that the fluid may move to the tub 50 through the manual detergent supply device 100.

In this case, the wash hole 114 of the manual detergent supply device 100 may be provided at a position corresponding to the drain 390. The second connector 420 may include a connection tube 421 formed by the drain groove 392 extending towards the manual detergent supply device 100 and a connection space 422, which is a space formed inside the connection tube 421.

The connecting space 422 may have the same diameter as the drain hole 391.

One end of the connection tube 422 may be formed by an extension of the drain groove 392, and the opposite end of the connection tube 422 may be formed by an extension of the wash hole 114.

The second connector 420 may further include a gasket 423 provided along an outer circumferential surface of the connector 422 at the opposite end of the connector 422.

The gasket 423 may be arranged between the outer circumferential surface of the connector 422 and an inner circumferential surface of the wash hole 114 to secure the connector 422 to the interior of the wash hole 114.

Since the second connector 420 is integrated with the drain 390 and the manual detergent supply device 100, there is no risk of leakage of the fluid. Further, the second connector 420 and the manual detergent supply device 100 may be securely fixed using the gasket 423.

Figure 16:
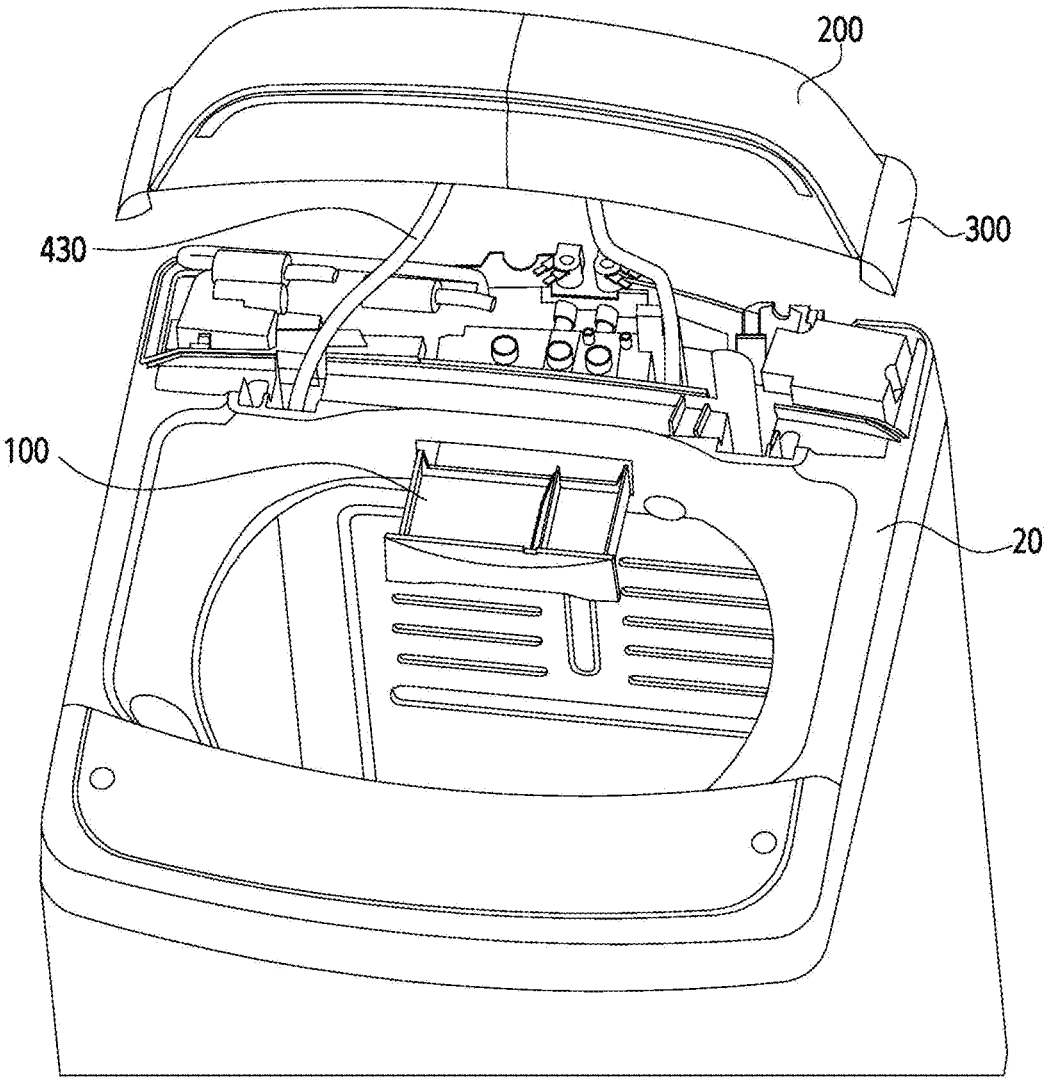
FIG. 16 shows a connector according to one embodiment of the present disclosure.
Figure 17:
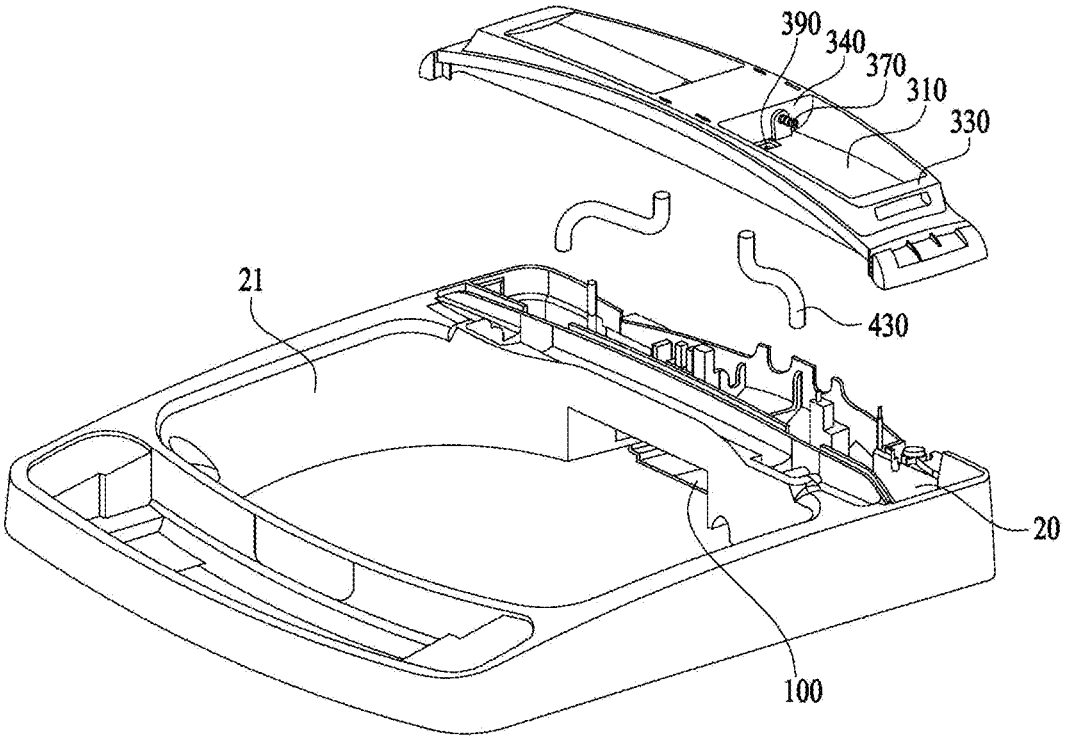
FIG. 17 shows a detailed structure of the connector according to the embodiment of the present disclosure.

FIG. 16 is a perspective view showing a connector according to one embodiment of the present disclosure, and FIG. 17 a detailed structure of the connector according to one embodiment of the present disclosure.

According to one embodiment of the present disclosure, a laundry treating apparatus including the connector 400 having an opposite end provided at the open top of the tub 50 may be provided. Thereby, the fluid may flow directly from the automatic detergent supply device 1000 to the tub 50 without passing through the manual detergent supply device 100.

Specifically, a third connector 430 according to the embodiment of the present disclosure may have one end connected to the drain 390 and an opposite end provided at the open top of the tub 50. The opposite end of the third connector 430 may be provided in the top cover 20.

Furthermore, the third connector 430 includes an elastic hose. Accordingly, even when the drain 390 and the space of the top cover 20 in which the opposite end of the third connector 430 is provided are not arranged to face each other, the fluid may be allowed to flow by connecting the drain 390 and the manual detergent supply device 100, avoiding the complex structure inside the top cover 20.

Thus, the fluid may be discharged directly into the tub 50 through an empty space, avoiding the complex structure inside the top cover 20. Accordingly, the space inside the top cover 20 may be efficiently used.

Figure 18:
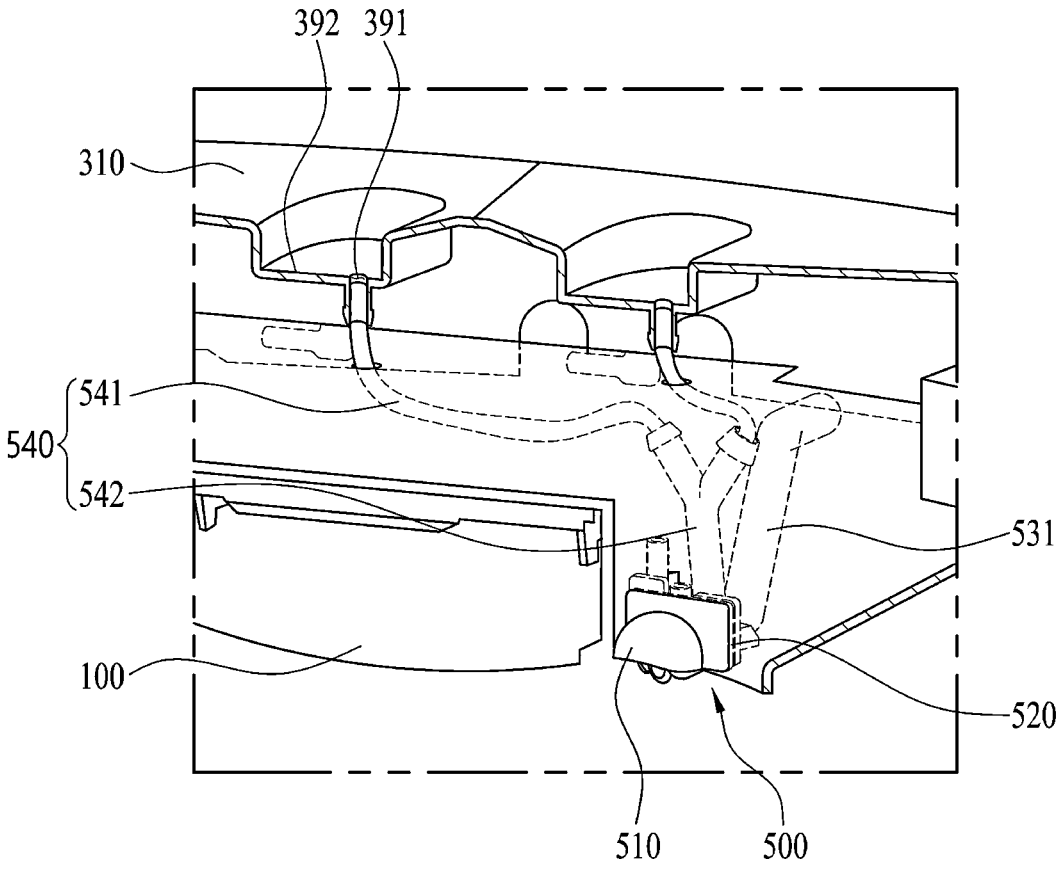
FIG. 18 shows a sprayer and a connector according to one embodiment of the present disclosure.
Figure 19:
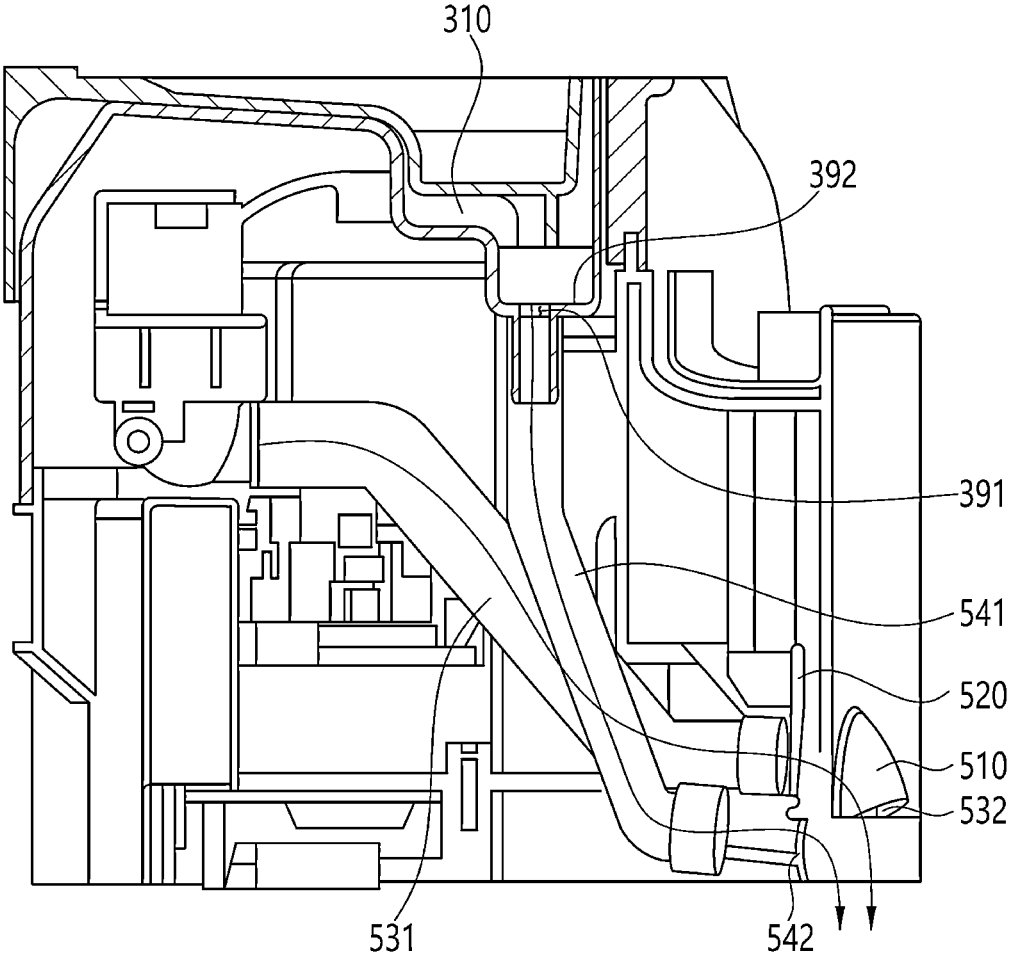
FIG. 19 is a cross-sectional view showing the sprayer.

FIG. 18 shows a sprayer and a connector according to one embodiment of the present disclosure, and FIG. 19 is a cross-sectional view of the sprayer.

According to one embodiment of the present disclosure, the mounting part 300 may have a drain groove 392 formed by recessing a portion of the mounting groove 310. The drain groove 392 may include a drain hole 391 through which the fluid is discharged. The drain hole 391 may be provided with a connector 400 connecting the drain hole 391 and the tub 50 for communication.

The laundry treating apparatus of the present disclosure may further include a sprayer 500 disposed facing the tub to spray water. The sprayer 500 may be disposed next to the manual detergent supply device 100.

The drain hole 391 may be connected to the sprayer 500 by the connector 400. That is, one end of the connector 400 may be connected to the drain hole 391 and the opposite end of the connector 400 may be connected to the sprayer 500.

Thereby, fluid remaining in the mounting groove 310 may be supplied to the tub 50 via the connector 400 using the pressure of water supplied from the water supply 70.

The sprayer 500 may further include a drainage part 540 connected to the opposite end of the connector 400 and disposed facing the tub 50. The drainage part 540 may include a drainage hose 541 connected to the opposite end of the connector 400 and a drainage nozzle 542 connected to the drainage hose 541 and disposed facing the tub 50 to spray water.

In other words, the drain hole 391 is connected to the drainage nozzle 542 on the side of the drainage part 540 by the connector 400. In an embodiment, the two connectors 400 connected to the drain hole 391 may merge into the drainage hose 541, and the drainage hose 541 may be connected to the drainage nozzle 542.

The sprayer 500 may include a spray portion 530 connected to the water supply 70 and disposed facing the tub 50. The water sprayed through the spray portion 530 may be supplied at a higher pressure than is normally supplied.

The spray portion 530 may include a spray hose 531 connected to the water supply 70 and a spray nozzle 532 connected to the spray hose 531 and disposed facing the tub 50 to spray water.

In this case, the spray nozzle 532 and the drainage nozzle 542 may be spaced apart from each other. In other words, fluid discharged through the drain hole 391 may be sprayed through the connector 400, past the drainage hose 541 and the drainage nozzle 542 and into the tub 50, but at a different location than water sprayed through the spray portion 530.

FIG. 20 is an enlarged view showing the sprayer, and FIG. 21 is an enlarged view showing the sprayer.

The sprayer 500 may be covered by a sprayer cover 510. The spray nozzle 532 may be positioned in the sprayer 500. The spray nozzle 532 may be connected to the spray hose 531. That is, the spray nozzle 532 may receive water from the water supply 70 and spray the same towards the inside of the tub 50.

The sprayer 500 may include a bracket 520 on which the spray nozzle 532 is arranged. The bracket 520 may be coupled to the top cover 20. The drainage nozzle 542 may be coupled to the bracket 520.

In this case, the spray nozzle 532 and the drainage nozzle 542 may be spaced apart from each other. That is, the fluid discharged through the drain hole 391 may be sprayed through the connector 400, past the drain hose 541 and the drainage nozzle 542, and into the tub 50, but at a different location than water sprayed through the spray portion 530.

Thus, with the structure of the bracket 520 in which the spray nozzle 532 is arranged, any fluid such as laundry agent or water remaining in the mounting groove 310 may be drained through the drain hole 391 and discharged into the tub 50 through the connector 400 and the drainage nozzle 542.

Thereby, the exposure of the drainage nozzle 542 to the user may be minimized and residual laundry agent or the like may be easily discharged.

The invention claimed is:

1. A laundry treating apparatus comprising:

a cabinet having a top cover including an inlet;

a tub located inside the cabinet, the tub being configured to store water therein;

a drum rotatably located in the tub, the drum being configured to accommodate laundry therein;

a mounting part located on the top cover, the mounting part being configured to deliver a first laundry agent to the tub;

a first storage part detachably mounted on the mounting part, the first storage part configured to store the first laundry agent, wherein the mounting part includes:

a mounting groove configured to support the first storage part;

a communication passage located in the mounting groove, the communication passage being configured to communicate with the first storage part; and a drain hole located in the mounting groove, the drain hole being in communication with the tub, wherein the first laundry agent stored in the first storage part is delivered to the tub through the mounting part, and wherein a fluid present in the mounting groove is discharged to the tub through the drain hole.

2. The laundry treating apparatus of claim 1, wherein the mounting groove is inclined downwardly towards the drain hole.

3. The laundry treating apparatus of claim 2, wherein the mounting groove further includes a drain groove recessed downward, the drain hole being located in the drain groove.

4. The laundry treating apparatus of claim 1, wherein the first storage part is configured to be detachable in a width direction of the cabinet.

5. The laundry treating apparatus of claim 4, wherein the mounting groove further includes a restriction surface located at an inner side or a first end of the mounting groove to support the first storage part, wherein the communication passage is located on the restriction surface, and wherein the drain hole is located in a bottom surface of the mounting groove.

6. The laundry treating apparatus of claim 1, further comprising a connector extending from the drain hole to allow the fluid present in the mounting groove to flow therethrough.

7. The laundry treating apparatus of claim 6, further comprising a second storage part provided in the top cover to store a second laundry agent therein, wherein a first end of the connector is connected to the drain hole, and wherein a second end of the connector is connected to the second storage part to discharge the fluid present in the mounting groove into the tub through the second storage part.

8. The laundry treating apparatus of claim 7, wherein the connector is a hose.

9. The laundry treating apparatus of claim 7, wherein the second storage part includes a wash hole located at a position corresponding to the drain hole, and wherein the second end of the connector is connected to the wash hole.

10. The laundry treating apparatus of claim 9, wherein the connector is integrally formed with the mounting part.

11. The laundry treating apparatus of claim 10, further comprising a gasket located along an outer circumferential surface of the connector at the second end of the connector.

12. The laundry treating apparatus of claim 11, wherein the second storage part includes:

a first body;

a drawer slidably mounted in the first body.

13. The laundry treating apparatus of claim 12, wherein the second storage part includes a second body located between the drawer and an upper surface of the first body, the second body configured to store the second laundry agent therein.

14. The laundry treating apparatus of claim 7, wherein the second storage part includes:

a first body;

a drawer slidably mounted in the first body.

15. The laundry treating apparatus of claim 14, wherein the second storage part includes a second body located between the drawer and an upper surface of the first body, the second body configured to store the second laundry agent therein.

16. The laundry treating apparatus of claim 6, wherein a first end of the connector is connected to the drain hole, and wherein a second end of the connector is at an open top of the tub.

17. The laundry treating apparatus of claim 6, further comprising a sprayer facing the tub, wherein a first end of the connector is connected to the drain hole, and wherein a second end of the connector is connected to the sprayer.

18. The laundry treating apparatus of claim 17, further comprising a water supply provided at the cabinet to supply water to the tub, wherein the sprayer includes a spray nozzle connected to the water supply, the spray nozzle being arranged to face the tub.

19. The laundry treating apparatus of claim 18, wherein the sprayer further includes a drainage nozzle connected to the second end of the connector, the drainage nozzle being arranged to face the tub, and wherein the spray nozzle and the drainage nozzle are spaced apart from each other.

20. The laundry treating apparatus of claim 1, wherein the first storage part is detachably mounted on the mounting part in a height direction of the cabinet, and wherein a bottom surface of the mounting groove includes the communication passage and the drain hole.

* * * * *